US008280296B2

(12) United States Patent
Ichikawa et al.

(10) Patent No.: US 8,280,296 B2
(45) Date of Patent: Oct. 2, 2012

(54) POWDER TRANSPORTING DEVICE AND IMAGE FORMING APPARATUS

(75) Inventors: Tomoya Ichikawa, Kanagawa (JP); Tadashi Ishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 478 days.

(21) Appl. No.: 12/337,215

(22) Filed: Dec. 17, 2008

(65) Prior Publication Data

US 2009/0324294 A1 Dec. 31, 2009

(30) Foreign Application Priority Data

Jun. 25, 2008 (JP) ..... P2008-166532

(51) Int. Cl.
*G03G 21/12* (2006.01)

(52) U.S. Cl. ..... 399/360; 399/35; 399/257

(58) Field of Classification Search ..... 399/35, 399/120, 252, 257, 258, 358–359, 360
See application file for complete search history.

(56) References Cited

U.S. PATENT DOCUMENTS

| | | | | |
|---|---|---|---|---|
| 2009/0016793 | A1* | 1/2009 | Umehara et al. | 399/358 |
| 2009/0154972 | A1* | 6/2009 | Tanaka et al. | 399/358 |
| 2010/0080578 | A1* | 4/2010 | Ichikawa | 399/34 |
| 2010/0080579 | A1* | 4/2010 | Yamaguchi et al. | 399/35 |
| 2010/0080580 | A1* | 4/2010 | Yamaguchi et al. | 399/35 |
| 2010/0080637 | A1* | 4/2010 | Yamaguchi et al. | 399/358 |
| 2010/0080638 | A1* | 4/2010 | Ichikawa et al. | 399/358 |
| 2010/0119270 | A1* | 5/2010 | Hoshino et al. | 399/358 |
| 2010/0239341 | A1* | 9/2010 | Tanaka et al. | 399/360 |
| 2010/0247191 | A1* | 9/2010 | Ichikawa et al. | 399/358 |
| 2010/0247192 | A1* | 9/2010 | Ishikawa et al. | 399/358 |

FOREIGN PATENT DOCUMENTS

| | | |
|---|---|---|
| JP | 09-265231 | 10/1997 |
| JP | 11-296042 | 10/1999 |
| JP | 2000-155513 | 6/2000 |
| JP | 2000-330440 | 11/2000 |
| JP | 2001-154556 | 6/2001 |
| JP | 2005-091848 | 4/2005 |
| JP | 2006-276811 | 10/2006 |
| JP | 2007-011413 | 1/2007 |

* cited by examiner

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

A powder transporting device includes: a dropping path through which developer drops; a loosening member that is arranged in the dropping path, and loosens the developer applied on an inner wall of the dropping path; a supporting portion that is provided on the inner wall of the developing path, and supports the loosening member; a rotary member that includes: a rotary center; and a reciprocation applying portion that is located at a position eccentric from the rotary center, the rotary member being arranged within the dropping path and rotationally driven; and a reciprocation applied portion that is provided on the loosening member, and is brought into contact with the reciprocation applying member, wherein the loosening member is moved along the inner wall of the dropping path by contact between the reciprocation applying member and the reciprocation applied portion while the rotary member rotates.

18 Claims, 12 Drawing Sheets

POWDER TRANSPORTING DEVICE AND IMAGE FORMING APPARATUS

CROSS-REFERENCE TO RELATED APPLICATIONS

This application is based on and claims priority under 35 U.S.C. 119 from Japanese Patent Application No. 2008-166532 filed Jun. 25, 2008.

BACKGROUND

Technical Field

This invention relates to a powder transporting apparatus and an image forming apparatus. The powder transporting apparatus and the image forming apparatus are applied to transportation of a powder, especially, a developer. Chemicals, resin powder, pigment and abrasive compound are used as the powder. It is preferred that Average particle size is from 1 μm to 500 μm.

SUMMARY

According to an aspect of the present invention, a powder transporting device includes: a dropping path through which powder drops; a loosening member that is arranged in the dropping path, and loosens the powder applied on an inner wall of the dropping path; a supporting portion that is provided on the inner wall of the dropping path, and supports the loosening member; a rotary member that includes; a rotary center; and a reciprocation applying portion that is located at a position eccentric from the rotary center, the rotary member being arranged within the dropping path and rotationally driven; and a reciprocation applied portion that is provided on the loosening member, and is brought into contact with the reciprocation applying member, wherein the loosening member is moved along the inner wall of the dropping path by contact between the reciprocation applying member and the reciprocation applied portion while the rotary member rotates.

BRIEF DESCRIPTION OF THE DRAWINGS

Exemplary embodiment of the present invention will be described in detail based on the following figures, wherein:

FIG. 4A is a perspective view when seen from the rear in a right oblique upward direction and FIG. 4B is a view for explaining a gear frame seen from the front;

FIG. 7A is a view for explaining the state when the swinging member moved rightward, and FIG. 7B is a view for explaining the state when the crank rotates 180° from the state of FIG. 7A so that the swinging member moved leftward.

FIG. 9A is a view for explaining the state when the swinging member moved rightward, and FIG. 9B is a view for explaining the state when the crank rotates 180° from the state of FIG. 9A so that the swinging member moved leftward;

FIG. 10A is a lateral view for explaining a developer dropping unit according to Embodiment 1, FIG. 10B is a view for explaining the state when the swinging member moved rightward.

FIG. 11A is a view for explaining the state when the swinging member moved rightward; and FIG. 11B is a view for explaining the state when the crank rotates 180° from the state of FIG. 11A so that the swinging member moved leftward; FIG. 12A is a view before a crank contact of the swinging member is formed and FIG. 12B is a view after a crank contact of the swinging member has been formed.

DETAILED DESCRIPTION

Figure 1:
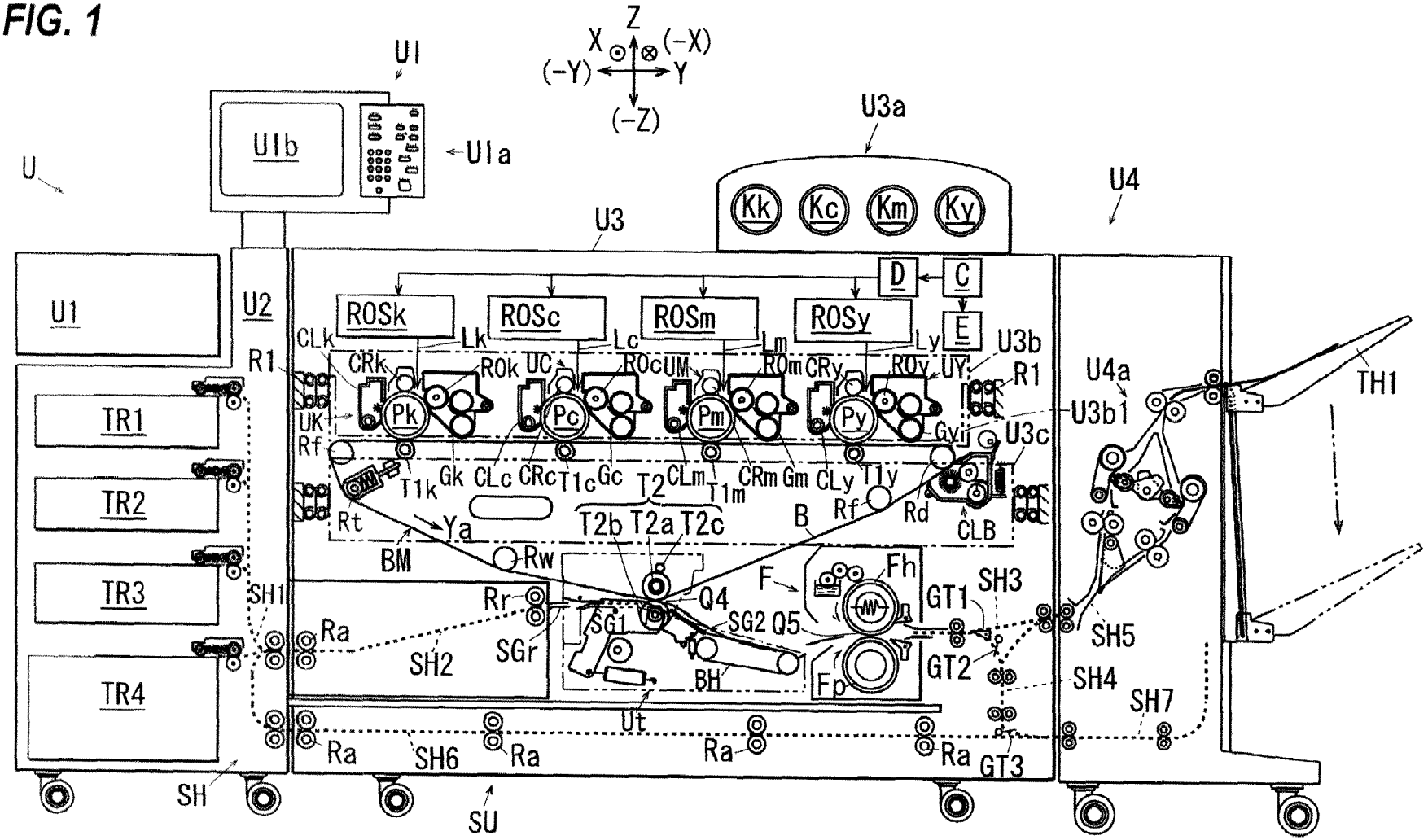
FIG. 1 is a view for explaining the entire arrangement of an image forming apparatus according to an exemplary embodiment of this invention.

Now referring to the drawings, an explanation will be given of examples of the mode for carrying out the invention (hereinafter referred to as embodiments), but this invention should not be limited to the following embodiments.

For facilitating the understanding of the following explanation, it is assumed in the drawings that the fore-and-after direction is an X-axis direction, the left-and-right direction is a Y-axis direction and the up-and-down direction is a Z-axis direction, and also assumed that the directions or sides denoted by arrows X, −X, Y, −Y, Z and −Z are forward, rearward, rightward, leftward, upward and downward, or front side, rear side, right side, left side, upper side and lower side, respectively.

Further, in the drawings, the symbol containing "•" in "o" unit the arrow going from rear to front of the paper face, and the symbol containing "×" in "o" unit the arrow going from front to rear of the paper face.

Embodiment 1

In the following explanation referring to the drawings, for easiness of understanding, the members other than those necessary for explanation will not be appropriately illustrated.

FIG. 1 is a view for explaining the entire arrangement of an image forming apparatus according to the exemplary embodiment of this invention.

In FIG. 1, a copier U which is an example of the image forming apparatus includes an operating unit UI, an image inputting device U1, a medium supplying device U2, an image forming apparatus body U3 and paper processing device U4.

(Operating Unit)

The operating unit UI has an inputting button UIa used to start copying or set the number of sheets to be copied. The operating unit UI has also a display UIb on which the contents inputted by the inputting button UIa and status of the copier U are displayed.

(Image Inputting Device)

The image inputting device U1 includes an automatic document feed device, an image reading device, etc. Light is put onto an arranged paper, the reflected light is received by a solid-state image pickup device, and the light received is converted into image information of red R, green G and blue B which are supplied to the image forming apparatus body U3 at predetermined times or "timings".

(Medium Supplying Device)

The medium supplying device U2 includes a plurality of sheet feeding trays TR1, TR2, TR3 and TR4 which are one example of a medium housing vessel. The medium supplying device U2 has also a medium supplying path SH1 for transporting the recording sheet S, an example of the medium for image recording taken from each of the sheet feeding trays TR1 to TR4 to the image forming apparatus U3.

(Image Forming Apparatus Body)

In FIG. 1, the image forming apparatus body U3 includes an image recording unit for recording an image on the recording sheet S transported from the medium supplying device U2, a developer adding device U3*a*, a sheet transporting path SH2, a sheet ejecting path SH3, a sheet inverting path SH4 and a sheet circulating path SH6.

Further, the image forming apparatus body U3 includes a control unit C, a laser driving circuit D which is an example of a latent image forming apparatus driving circuit controlled by the control unit C and a power supply circuit E. The laser driving circuit D converts the image information of red R, green G and blue B inputted from the image inputting device U1 into the image information of Y (yellow), M (magenta), C (cyan) and K (black) and outputs, at predetermined timings, the corresponding driving signals to latent image forming devices ROSy, ROSm, ROSc and ROSk for individual colors.

Beneath the latent image forming devices ROSy, ROSm, ROSc and ROSk for individual colors, a drawer U3*b* for a visible image forming device which is an example of a drawing member is movably supported between a drawing position at the front of the image forming apparatus body U3 and a mounting position within the image forming apparatus body U3 by slide rails R1 and R1 which are an example of a pair of left and right guiding members.

Figure 2:
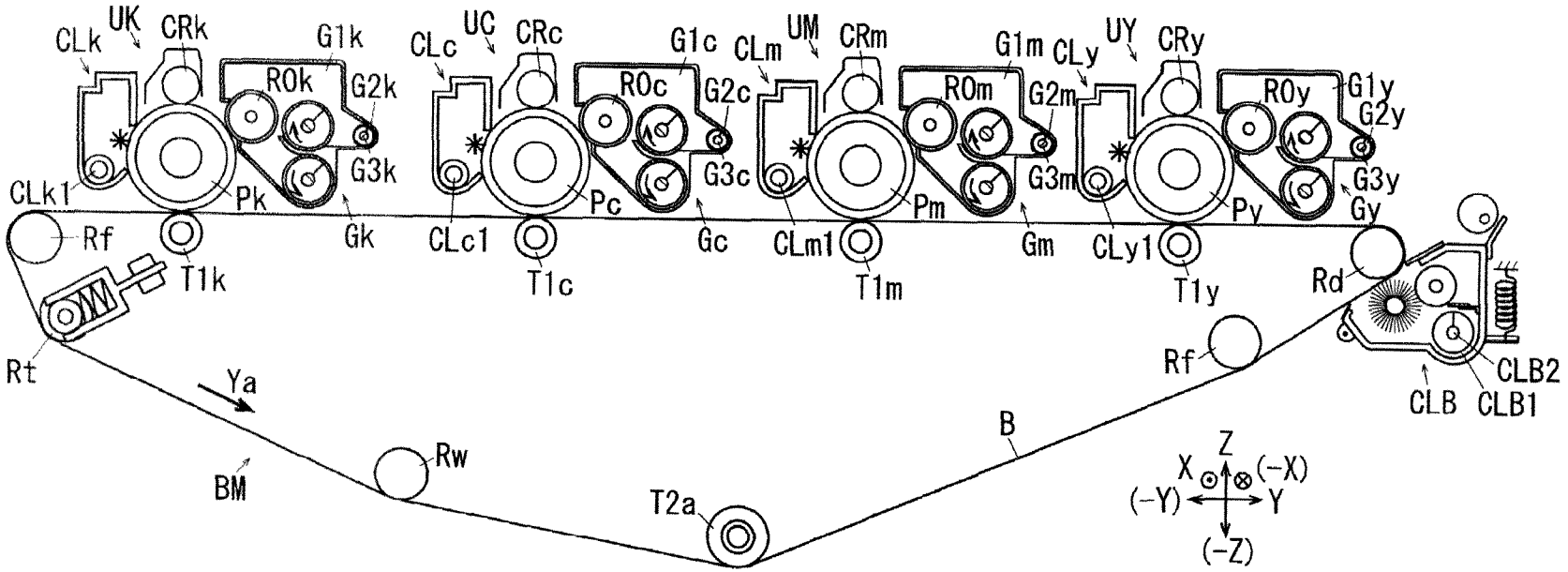
FIG. 2 is an enlarge view for explaining the visible image forming apparatus and an intermediate transfer body cleaner.

FIG. 2 is an enlarged view for explaining the visible image forming device and an intermediate transfer body cleaner.

In FIGS. 1 and 2, a photosensitive body unit UK of a K color which is an example of a developer holder unit includes a photosensitive body drum Pk which is an example of the developer holder and also an example of an image holder on which a latent image or a toner image of toner is formed; a charging roll CRk which is an example of a charger; and a cleaner CLk which is an example of a developer holder cleaner and also an example of an image holder cleaner.

Further, as regards the other colors Y, M, C also, a photosensitive body unit UY, UM, UC includes a photosensitive drum Py, Pm, Pc, a charging roll CRy, CRm, CRc which is an example of the charger, and a cleaner CLy, CLm, CLc.

The photosensitive body unit UK for the K color and developing device Gk having a developing roll ROk constitute a visible image forming device UK+Gk for the K color. Likewise, the photosensitive body unit UY, UM, UC for Y, M, C and the developing device Gy, Gm, Gc having a developing roll ROy, ROm, ROc constitute a visible image forming device UY+Gy, UM+Gm, UC+Gc for Y, M, C, respectively.

The drawer U3*b* for the visible image forming device includes a drawer body U3*b*1 which is an example of a holder in which the photosensitive body units UY, UM, UC, UK and developing devices Gy, Gm, Gc, Gk are detachably mounted.

In FIG. 1, the surface of the photosensitive body drum Py, Pm, Pc, Pk which rotates is uniformly charged by the charging roll CRy, CRm, CRc, CRk. Thereafter, a latent image is formed on the surface of the rotating photosensitive drum Py, Pm, Pc, Pk by the laser beam Ly, Lm, Lc, Lk which is an example of latent image writing light outputted from the latent image forming device ROSy, ROSm, ROSc, ROSk. The latent image on the photosensitive drum Py, Pm, Pc, Pk surface is developed as the toner image which is an example of the visible image of Y (yellow), M (magenta), C (cyan), K (black) by the developing device Gy, Gm, Gc, Gk.

In the developing device Gy to Gk, the developer consumed by development is added from a toner cartridge Ky, Km, Kc, Kk which is an example of the developer housing vessel detachably mounted in the developer adding device U3*a*. In Embodiment 1, a two-component developer containing a toner and a carrier is employed as the developer. From the toner cartridge Ky, Km, Kc, Kk, a "high density developer" having a higher density than that in the developing device Gy, Gm, Gc, Gk is added. Therefore, in the developing device Gy, Gm, Gc, Gk in Embodiment 1, carrier exchange is done by little by little exhausting the developer containing the deteriorated carrier from the developing device Gy, Gm, Gc, Gk while adding the high density developer containing a small quantity of carrier. Such a technique for exchanging the carrier little by little is conventionally known, and described in e.g. JP-A-2000-81787 and JP-A-2003-84570, and so its detailed explanation will not be given.

In the developing device Gy, Gm, Gc, Gk, the developer containing the deteriorated carrier is exhausted from a deteriorated developer exhaust opening G1*y*, G1*m*, G2*c*, G1*k* to the rear end of the developing device Gy, Gm, Gc, Gk and the developer containing a new carrier is added from the toner cartridge Ky, Km, Kc, Kk. In this way, the developer within the developing device Gy, Gm, Gc, Gk is exchanged for the new carrier. The developer exhausted from the deteriorated developer exhaust opening G2*y*, G2*m*, G2*c*, G2*k* flows into a deteriorated developer transporting path G1*y*, G1*m*, G1*y*, G1*k* extending backward and is transported backward by a deteriorated developer transporting member G3*y*, G3*m*, G3*c*, G3*k* arranged in the deteriorated developer transporting path G2*y*, G2*m*, G2*c*, G2*k*.

The toner images on the photosensitive body Py, Pm, Pc, Pk surfaces are superposedly transferred onto an intermediate transfer belt B by primary transfer rolls T1*y*, T1*m*, T1*c*, T1*k* which are an example of a primary transfer device. The intermediate transfer belt B is an example of an intermediate transfer body which is an example of the developer holder and on which the toner images of the photosensitive drums Pk to Pc are intermediately transferred. Thus, a multiple color image is formed on the intermediate transfer belt B. The color toner image which is an example of the multiple color visible image formed on the intermediate transfer belt B is transported to a secondary transfer region Q4.

Where there is only the image information of the K color, only the photosensitive drum Pk of K color and developing device Gk are employed so that the toner image of the K color will be formed.

After the primary transfer, the residue such as the remaining developer and paper powder applied on the photosensitive drum Py, Pm, Pc, Pk surface is removed by the cleaner CLy, CLm, CLc, CLk.

Beneath drawer U3*b* for the visible image forming device, a drawer U3*c* for the intermediate transfer device, which is an example of the drawing member is movably supported between a drawing position at the front of the image forming apparatus body U3 and a mounting position within the image forming apparatus body U3. A belt module BM which is an example of the intermediate transfer device is supported by the drawer U3*c* for the intermediate transfer device between the ascending position in contact with the lower surface of the photosensitive drum Py, Pm, Pc, Pk and the descending position away downward from the lower surface.

The belt module BM includes the intermediate transfer belt B; a belt supporting roll Rd+Rt+Rw+Rf+T2*a* as an example of an intermediate transfer member supporting member (which consists of an driving roll Rd which is an example of an intermediate transfer body driving member, a tension roll Rt which is an example of a tens ion generating member, a walking roll Rw which is an example of a meandering preventing member, a plurality of idler rollers Rf which are an example of a driven member and a backup roller T2*a* which is an example of a secondary transfer opposite member); and the primary transfer rolls T1*y*, T1*m*, T1*c*, T1*k*. The intermediate transfer belt B is supported by the belt supporting roll Rd+Rt+Rw+Rf+T2*a* so that it is rotatable in an arrow Ya direction.

Beneath the backup roll T2*a*, a secondary transfer unit Ut is arranged. A secondary transfer roll T2*b* which is an example of a secondary transfer member of the secondary transfer unit Ut is arranged so that it can be separated from or brought in contact with the backup roll T2*a* across the intermediate transfer belt B. The region where the secondary transfer roll T2*b* is in pressure-contact with the intermediate transfer belt B constitutes the secondary transfer region Q4. A contact roll T2*c* which is an example of a contact power supplying member is in pressure-contact with the backup roll T2*a*. The contact roll T2*c* is supplied with a secondary transfer voltage with the same polarity as the charging polarity of the toner at predetermined timings from a power supply circuit E controlled by the control unit C.

The backup roll T2*a*, secondary transfer roll T2*b* and contact roll T2*c* constitute the secondary transfer device T2.

Beneath the belt module BM, a sheet transporting path SH2 is arranged. The recording sheet S fed from the medium supplying path SH1 of the medium supplying device U2 is transported to a register roll Rr which is an example of a transporting timing adjusting member of the sheet transporting path SH2 by a medium transporting roll Ra which is an example of a recording medium transporting member. The register roll Rr downstream transports the recording sheet S at the timing when the color toner image formed on the intermediate transfer belt B is transported to the secondary transfer region Q4. Thus, the recording sheet S is transported to the secondary transfer region Q4 by guidance of a register-side sheet guide SGr and a pre-transfer sheet guide SG1.

The register-side sheet guide SGr as well as the register roll Rr is secured to the image forming apparatus body U3.

The color toner image on the intermediate transfer belt B is transferred onto the recording sheet S by the secondary transfer device T2 when it passes the secondary transfer region Q4. In the case of the multiple color image, the toner images primary-transferred on the intermediate transfer belt B surface are collectively secondary-transferred onto the recording sheet S.

The primary transfer rolls T1*y* to T1*k*, secondary transfer device T2 and intermediate transfer belt B constitute the transfer devices T1*y* to T1*k* plus the secondary transfer device T2+B according to Embodiment 1.

The intermediate transfer belt B after the secondary transfer is cleaned by a belt cleaner CLB provided on the right lower side of the intermediate transfer belt B, which is an example of a developer holder cleaner and an example of an intermediate transfer body cleaner. By the belt cleaner CLB, the residue such as the developer on the intermediate transfer belt B left without being employed at the time of the secondary transfer and paper powder are removed from the intermediate transfer belt B. In FIG. 2, the residue removed from the intermediate transfer belt B flows into a belt cleaner residue transporting path CLB1 which is provided at the lower position within the belt cleaner CLB and extends rearward, and is transported by a belt cleaner residue transporting member CLB2 arranged within the belt cleaner residue transporting path CLB1 to the rear side of the image forming apparatus body U3. The secondary transfer roll T2*b* and belt cleaner CLB are arranged so that they can be freely separated from and brought into contact with the intermediate transfer belt B.

The recording sheet S with the toner image secondary-transferred is transported through a post-transfer sheet guide SG2 and a medium transporting belt BH which is an example of a transporting member to a fixing region Q5 where a fixing roll Fh of a fixing device F and a pressurizing roll Fp which is an example of a pressurizing/fixing member are brought into pressure-contact with each other. The toner image on the recording sheets is heated and fixed by the fixing device F when it passes the fixing region Q5. Downstream of the fixing device F, provided is a changing gate GT1 which is an example of a changing member. According to an instruction from a user, the changing gate GT1 selectively changes the recording sheet S transported along the sheet transporting path SH2 and subjected to the heating/fixing in the fixing region Q5 into the side of a sheet ejecting path SH3 or a sheet inverting path SH4 of the sheet processing device U4. The sheet S transported into the sheet ejecting path SH3 is transported to a sheet transporting path SH5 of the sheet processing device U4 and the curl or a warp of the sheet S is corrected by a curl correcting member U4*a* which is an example of a medium warp correcting member arranged on the sheet transporting path SH5. Thereafter, the sheet S with the image fixed plane oriented upward is ejected from an ejecting roll Rh which is an example of a medium ejecting member into an ejecting tray TH1 which is an example of a medium ejecting portion of the sheet processing device U4.

The sheet S transported onto the sheet inverting path SH4 of the image forming apparatus body U3 by the changing gate GT1 is transported to the sheet inverting path SH4 of the image forming apparatus body U3 through a Mylar gate GT2 which is an example of a flexible changing member.

At this time, where the recording sheet S with its image fixed plane oriented downward is ejected, immediately after the rear end of the recording sheet S passes the Mylar gate GT2, the recording sheet S is inverted. In this case, the Mylar gate GT2 once passes the recording sheets transported to the sheet inverting path SH4, transports it toward the sheet transporting paths SH3 and SH5. Thus, the recording sheet S with the image fixed plane oriented downward is ejected into the ejecting tray TH1.

To the way of the sheet inverting path SH4 of the image forming apparatus body U3, a sheet circulating path SH6 is connected. To its connecting point, a Mylar gate GT3 is connected. The downstream end of the sheet inverting path SH4 of the image forming apparatus body U3 is connected to a sheet inverting path SH7 of the sheet processing device U4.

The recording sheet S transported to the sheet transporting path SH4 through the changing gate GT1 is transported toward the sheet inverting path SH7 of the sheet processing device U4 by the Mylar gate GT3. In this case, the Mylar gate GT3 once passes the recording sheet S transported to the sheet inverting path SH4, as it is, and after the recording sheet S passed is inverted, transports it toward the sheet transporting path SH6.

Thus, the recording sheet S transported to the sheet circulating path SH6 is transported again to the transfer region Q4 through the medium supplying path SH1 and subjected to double-sided printing. The resultant sheet is transported into the sheet processing device U4 and ejected into the ejecting tray TH1.

The components denoted by symbols SH1 to SH7 constitute a sheet transporting path SH. The components denoted by symbols SH, Ra, Rr, Rh, SGr, SG1, SG2, BH and GT1 to GT3 constitute a sheet transporting device SU.

(Waste Powder Transporting Device)

Figure 3:
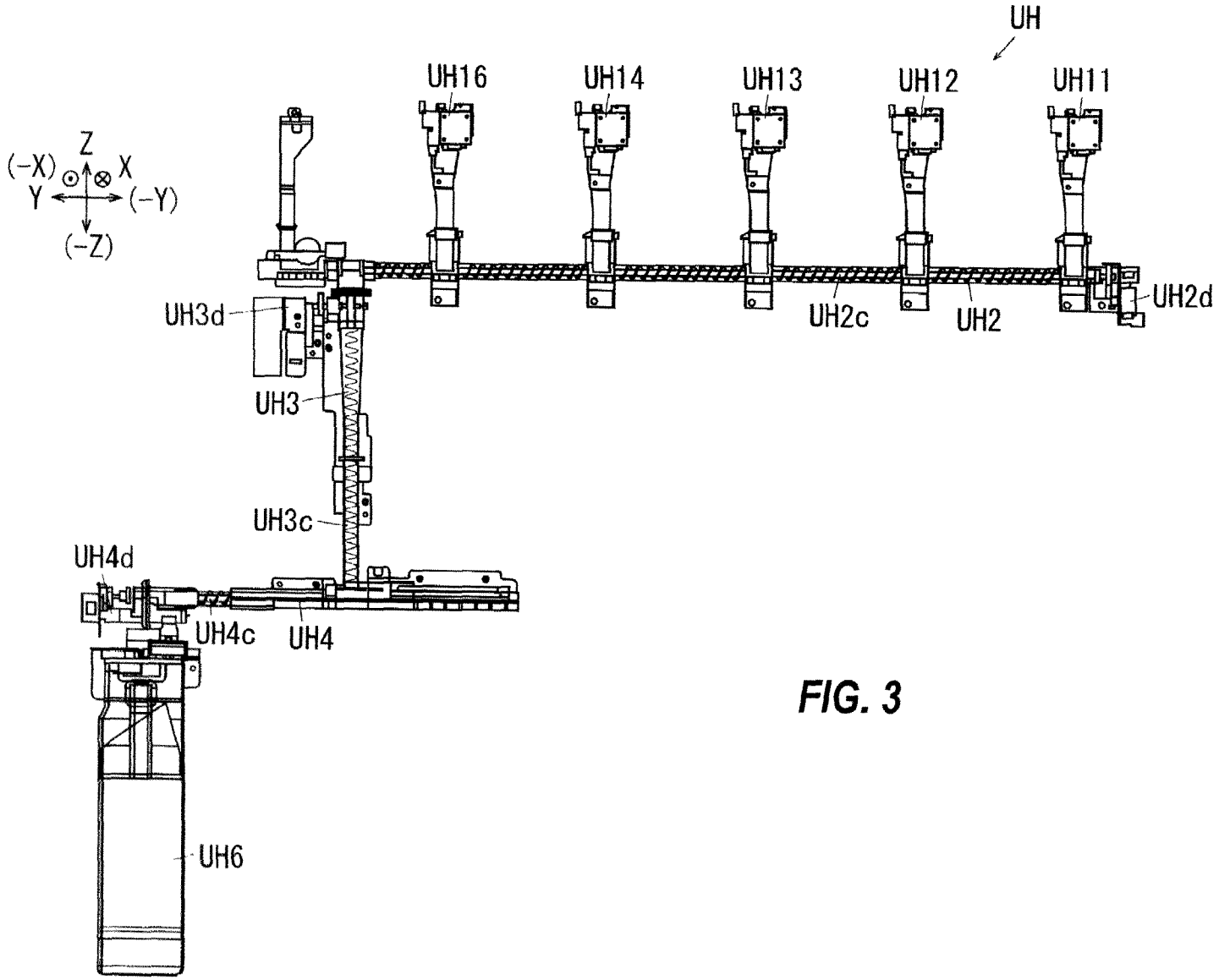
FIG. 3 is a view for explaining the main part of an entire powder transporting device.

FIG. 3 is a view for explaining the main part of an entire powder transporting device.

At the rear of the image forming apparatus body U3, supported is a waste powder transporting device UH which is an example of a powder transporting device.

The waste powder transporting device UH includes five developer dropping units UH11, UH12, UH13, UH14 and UH16 which extend in the up-and-down direction. The developer dropping unit UH11 arranged on the most left side, i.e. most Y-side (most right side in the illustration of FIG. 3) is connected to the residue transporting path CLk1 extending from the cleaner CLk.

The developer dropping unit UH12 located on the right side of the developer dropping unit UH11 is connected to the residue transporting path CLc1 extending from the cleaner CLc of the C color and the deteriorated developer transporting path G2*k* extending from the developing device Gk of the K color.

The developer dropping unit UH13 located on the right side of the developer dropping unit UH12 is connected to the residue transporting path CLm1 extending from the cleaner CLm of the M color and the deteriorated developer transporting path G2*c* extending from the developing device Gc of the C color.

The developer dropping unit UH14 located on the right side of the developer dropping unit UH13 is connected to the residue transporting path CLy1 extending from the cleaner CLy of the Y color and the deteriorated developer transporting path G2*m* extending from the developing device Gm of the M color. The developer dropping unit UH16 located on the right side of the developer dropping unit UH14 is connected to the residue transporting path CLB1 extending from the belt cleaner CLB and the deteriorated developer transporting path G2*y* extending from the developing device Gy of the Y color.

The lower ends of the developer dropping units UH11 to UH16 are connected to one another by a merging transporting path UH2 which extends horizontally. The merging transporting path UH2 in Embodiment 1 is connected to pass through the lower ends of the developer dropping units UH11 to UH16 in the left-and-right direction, and accommodates a merging transporting auger UH2*c* extending in the left-and-right direction which is an example of a transporting member. To the left end of the merging transporting auger UH2*c*, drive is transmitted from a merging transporting motor UH2*d* which is an example of a driving source so that the waste developer within the merging transporting path UH2 is transported from left to right.

The right end of the merging transporting path UH2 is connected to the upper end of a dropping direction transporting path UH3 extending in the up-and-down direction so that the waste developer transported to the right end of the merging transporting path UH2 flows into the dropping direction transporting path UH3 and is dropped and transported. The dropping direction path UH3 in Embodiment 1 accommodates a bridging preventing member UH3*c* which extends in the up-and-down direction and is reciprocated in the up-and-down direction to demolish the waste developer applied on the inner wall of the dropping direction transporting path UH3. The bridging preventing member UH3*c* in Embodiment 1 is formed of a "coil spring" which is a wire wound helically. At the right side of the upper part of the dropping direction transporting path UH3, a bridging preventing motor unit UK3*d* is supported which reciprocates the bridging preventing member UH3*c* in the up-and-down direction. The bridging preventing member UH3*c* and bridging preventing motor unit UH3*d* are described in e.g. JP-A-2005-091848 and so their detailed explanation will not be made.

A vessel transporting path UH4 extending in the left-and-right direction is connected to the lower end of the dropping direction transporting path UH3. The waste developer dropped through the dropping direction transporting path UH3 flows into the vessel transporting path UH4. The vessel transporting path UH4 accommodates a vessel transporting auger UH4*c* extending in the left-and-right direction. At the right end of the vessel transporting path UH4, a left-and-right direction transporting motor UH4*d* is supported. Drive is transmitted to the vessel transporting auger UH4*c* from the left-and-right direction motor UH4*d* so that the waste developer within the vessel transporting path UH4 is transported from left to right.

At the right end of the vessel transporting path UH4, a developer recovery vessel UH6 extending in the up-and-down direction is connected. The developer transported through the vessel transporting path UH4 flows into the developer recovery vessel UH6 so that it is recovered.

(Developer Dropping Unit)

The developer dropping units UH11 to UH16 will be explained below in detail, but they are constructed similarly except that the residue transporting path and deteriorated developer transporting path connected to the developer dropping units UH12 to UH14 are different. For this reason, the explanation will be given of only the developer dropping unit UH12 connected to the residue transporting path CLc1 extending from the cleaner CLc of the C color and the deteriorated developer transporting path G2*k* extending from the developing device Gk of the K color. The other developer dropping units UH13 and UH14 will not be explained. The developer dropping unit UH11 and the developer dropping unit UH16 are constructed similarly to the developer dropping units UH12 to UH14 except that a single transporting path but not two transporting paths is connected, and so their detailed explanation will not be made.

Figures 4A, 4B:
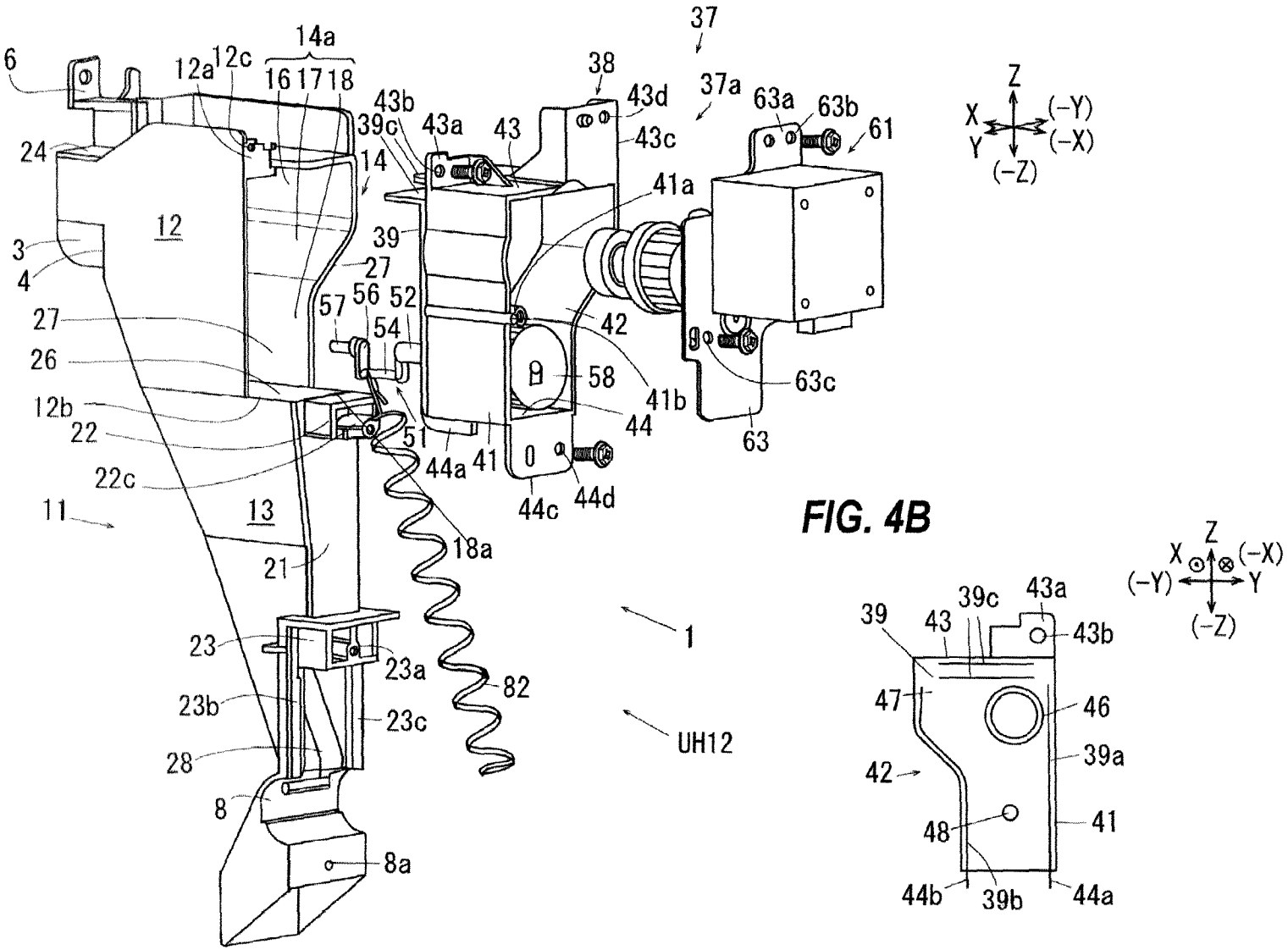
FIGS. 4A and 4B are views for explaining the developer dropping unit according to Embodiment 1.

FIG. 4 is a view for explaining the developer dropping unit according to Embodiment 1. FIG. 4A is a perspective view when seen from the rear in a right oblique upward direction. FIG. 4B is a view for explaining a gear frame seen from the front.

Figure 5:
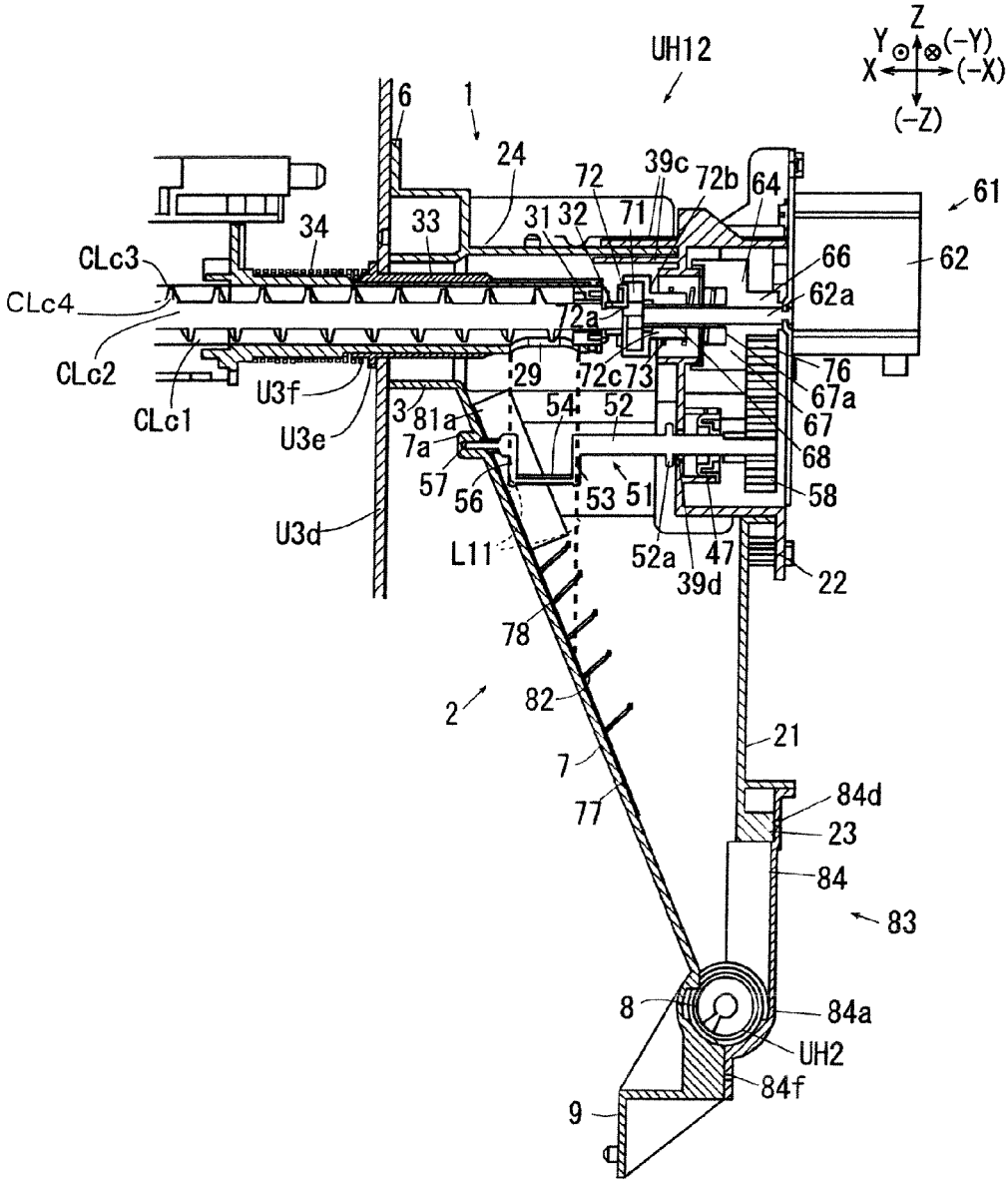
FIG. 5 is a view for explaining the state seen from the side where the residue transporting path supported by the developer dropping unit according to Embodiment 1.

FIG. 5 is a view for explaining the state seen from the side where the residue transporting path supported by the developer dropping unit according to Embodiment 1.

Figure 6:
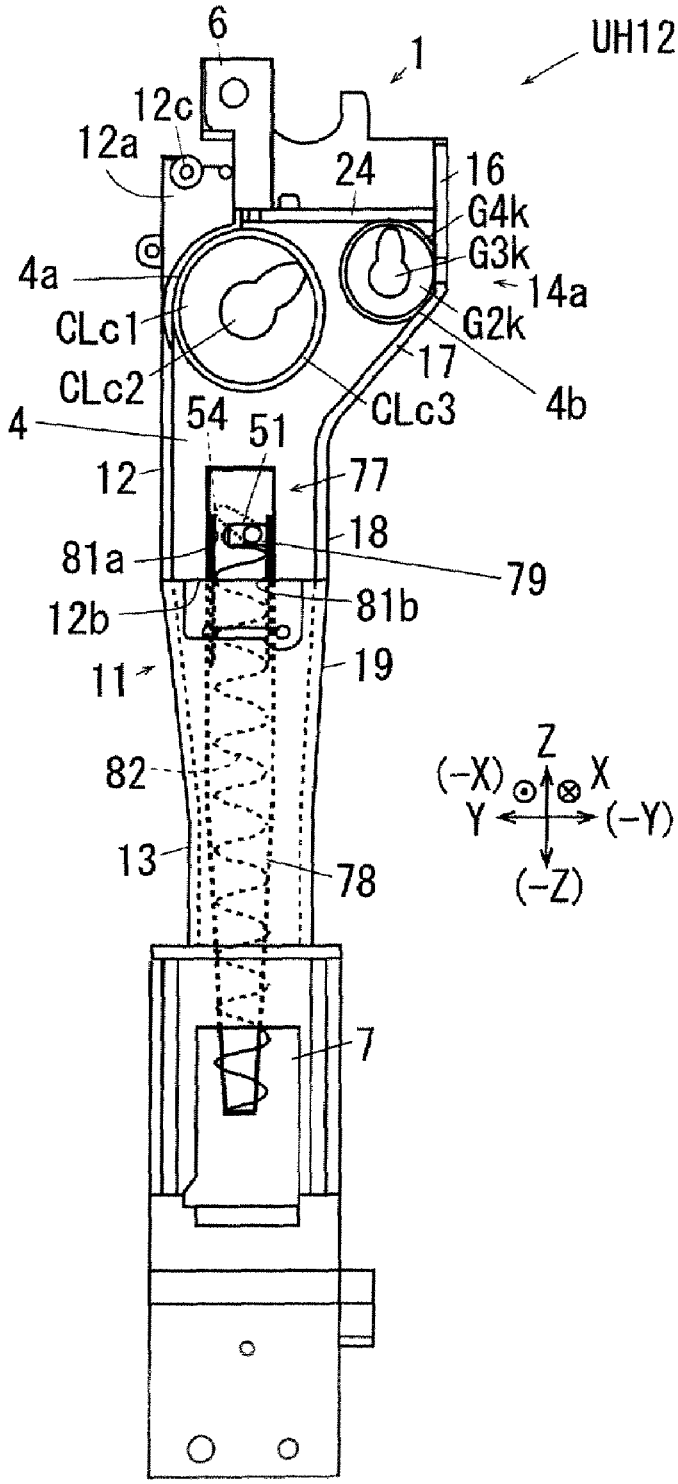
FIG. 6 is a view for explaining the main part of a developer dropping frame when seen from the rear.

FIG. 6 is a view for explaining the main part of a developer dropping frame when seen from the rear.

In FIGS. 4 to 6, the developer dropping unit UH12 body has a developer dropping frame 1 which is an example of a dropping path forming frame extending in the up-and-down direction. The developer dropping frame 1 has a front wall 2 located on the front side. At the upper end of the front wall 2, a cylindrical transporting path receiving portion 3 projecting forward is formed. At the rear of the transporting path receiving portion 3, a transporting path supporting wall 4 extending in the up-and-down direction is formed.

In FIG. 6, the transporting path supporting wall 4 has a cleaner-use transporting path through-hole 4*a* on the right side and a developing device use transporting path through-hole 4*b* on the left side. In FIGS. 5 and 6, above the transporting path receiving portion 3, an upper flange 6 is provided which is an example of a secured portion secured to a body frame U3*a* which is a frame of the image forming apparatus body U3. In FIG. 5, at the lower part of the transporting path receiving portion 3, a front inclining wall 7 is integrally formed which is an example of a wall inclining obliquely rearward gradually downward. At the upper part of the front side inclining wall 7, a front bearing 7*a* which is an example of a supporting portion formed in a projection shape projecting forward and dented forward on the rear side. At the lower end of the front inclining wall 7, formed is a semi-arc-like front merging transporting path receiving portion 8 corresponding to the front outer periphery of the merging transporting path UH2. In FIG. 4, on the rear face at the lower end of the front merging transporting receiving portion 8, a lower cover securing screw hole 8*a* is formed which is an example of a lower covering member secured portion. At the lower end of the front merging transporting receiving 8 portion, a lower flange 9 is formed which is an example of a secured portion supported by the frame of the image forming apparatus body not shown.

The developer dropping frame 1 has a right side wall 11 arranged on the right side of the front wall 2 and extending in the up-and-down direction.

The right side wall 11 has a right upper wall 12 extending in the up-and-down direction and a right lower wall 13 formed integrally below the right upper wall 12.

The front edges of the right upper wall 12 and right lower wall 13 are formed along the front inclining wall 7 of the front wall 2.

The rear edge of the right upper wall 12 is formed along the up-and-down direction. At the upper end of the edge of the right upper wall 12, an upper unit securing portion 12*a* is formed. The upper unit securing portion 12*a* has an upper unit securing screw hole 12*c* which is an example of a screw hole for the securing portion for securing an upper developer dropping frame. At the lower end of the rear edge of the right upper wall 12, a right step 12*b* extending rearward is formed.

The rear edge of the right upper wall 13 extends downward from the rear end of the right step 12*b*.

The developer dropping frame 1 has a left side wall 14 arranged on the left side of the front wall 2 and extending in the up-and-down direction.

At the upper end of the left side wall 14, an left upper end vertical wall 16 extending vertically is formed. At the lower end of the left upper end vertical wall 16, continuously formed is a left upper inclining wall 17 which inclines rightward gradually downward. At the lower end of the left upper inclining wall 17, a left upper vertical wall 18 extending vertically is formed. Below the left upper vertical wall 18, a left lower wall 19 is integrally formed thereto. Further, the left upper end vertical wall 16, left upper inclining wall 17 and left upper vertical wall 18 constitute the left upper wall 14*a*.

The front edges of the left upper vertical wall 18 and left lower wall 19 are formed along the front inclining wall 7 of the front wall 2.

The rear edge of the left upper vertical wall 18 is formed along the up-and-down direction. At the lower end of the rear edge of the left upper vertical wall 18, a left step 18*a* extending rearward is formed.

The rear edge of the left lower wall 19 extends downward from the rear edge of the left step 18*a*.

The rear edge of the right lower wall 13 and the rear edge of the left lower wall 19 are connected to each other by a rear wall 21 extending in the up-and-down direction.

At upper end of the rear wall 21, formed is a lower unit securing portion 22 projecting rearward from the rear wall 21. The lower unit securing portion 22 has a lower unit securing portion-use screw hole 22*c* which is an example of a screw hole for the securing portion for securing a lower developer dropping frame.

At the lower end of the rear wall 21, formed is a merging transporting path-use removable cover securing portion 23 which is an example of a covering member securing portion. At the upper end of the merging transporting path-use removable cover securing portion 23 for a cover upper end screw hole 23*a* is formed.

In FIG. 4, the upper end of the right upper wall 12 and the upper end of the left upper vertical wall 16 are connected to each other by a top wall 24 extending horizontally.

The space encircled by the front wall 2, right side wall 11, left side wall 14, rear wall 21 and top wall 24 constitutes a developer dropping path 26 which is an example of a dropping path.

At the upper rear of the developer dropping frame 1, a unit attaching opening 27 is formed by the rear edge of the right upper wall 12, upper edge of the right step 12*b*, upper edge of the rear wall 21, upper edge of the left step 18*a*, rear edge of the left upper wall 14*a* and rear edge of the top wall 24. The unit attaching opening 27 externally opens the upper rear of the developer dropping path 26.

At the rear lower end of the developer dropping frame 1, a cover attaching opening 28 is formed which is an example of a covering member attaching portion. The cover attaching opening 28 externally opens the lower end of the developer dropping path 26.

In FIGS. 1, 5 and 6, below the cleaner CLc, formed is a residue transporting path CLc1 which extends rearward and along which the residue recovered is transported. On the residue transporting path CLc1, auger CLc2 has a transporting blade CLc4 and serves as an example of a transporting member for cleaner CLc, as well as cleaners CLy, CLm, and CLk. A residue transporting cylinder CLc3 is connected to the rear end of the cleaner CLc. The residue transporting cylinder CLc3 extends rearward and has the residue transporting path CLc1 internally formed. The residue transporting cylinder CLc3 is removably mounted in the developer dropping frame 1 in a state where it passes through a frame through-hole U3*f* formed in the body frame U3*d* and the cleaner-use transporting path through-hole 4*a*.

At the rear end of the residue transporting cylinder CLc3, a residue dropping opening 29 is formed which is an example of a flow-in opening. In Embodiment 1, the residue dropping opening 29 is located behind the front bearing 7*a* formed in the front inclining wall 7. A bearing member 31 is supported at the rear end of the residue transporting cylinder CLc3. The rear end of the auger CLc2 is rotatably supported by the bearing member 31.

The rear end of the auger CLc2 passes rearward from the rear end of the residue transporting cylinder CLc3. At the rear end of the auger CLc2, a driven coupling 32 is supported which is an example of a well known driven transmitting member.

Further, on the outer side of the rear end of the residue transporting cylinder CLc3, supported are a dropping opening cover 33 which is an example of a dropping opening opening/closing member movable in the fore-and-aft direction and a cover closing spring 34 which is an example of an elastic member which pushes the dropping opening cover 33 rearward.

Therefore, where the cleaner CLc is mounted in the image forming apparatus body U3, the dropping cover opening 33 is limited by the frame through-hole U3*f* of the body frame U3*d* so that it moves forward relatively to the residue dropping opening 29. At this time, the cover closing spring 34 is deformed elastically to shrink so that the residue dropping opening 29 is opened. When the cleaner CLc is removed from the image forming apparatus body U3, the cover closing spring 34 is elastically restored so that the dropping cover 33 moves relatively rearward to close the residue dropping opening 29.

In FIGS. 5 and 6, a developing device use transporting cylinder G4*k*, which extends rearward and has the deteriorated developer transporting path G2*k* internally formed, is connected to the developing device Gk. The developing device use transporting cylinder G4*k* is detachably mounted in the developer dropping frame 1 in a state where it passes through a developing device use transporting path frame through-hole (not shown) and the developing device use transporting path through-hole 4*b* which are formed in the body frame U3*d*. At the rear end of the developing device use transporting path G4*k*, a developer dropping opening 36 is formed. Within the developing device use transporting cylinder G4*k*, arranged is the deteriorated developer transporting member G3*k* which transports the developer from the front toward the rear. Drive is transmitted from the driving motor (not shown) of the developing device Gk to the deteriorated developer transporting member G3*k*. The developing device-use transporting path G4*k* is provided with a dropping opening cover and a cover closing spring (not shown) which are constructed like the dropping opening cover 33 and the cover blocking spring 34 of the residue transporting path CLc3.

As a unit for transporting the developer within the developer transporting path, the developer transporting member to which drive is transmitted from the driving motor is employed. This is described in e.g. JP-A-2005-181515 and so will not be explained in detail.

At the unit attaching opening 27 of the developer dropping frame 1, detachably supported is a driving unit 37 which is an example of a loosening member driving unit.

The driving unit 37 includes a gear unit 37*a* which is an example of a drive transmitting unit arranged on the front side and a motor unit 61 described later arranged on the rear side of the gear unit 37*a*. The gear unit 37*a* has a gear frame 38 which is an example of a driving unit frame. The gear frame 38 includes a plate-like front side wall 39 located on the front side, a right side wall 41 extending rearward from the right side of the front side wall 39, a left side wall 42 extending rearward from the exit side, an upper side wall 43 extending rearward from the upper end and an lower side wall 44 extending rearward from the lower end.

In FIGS. 4 to 6, on the inner wall of the right side wall 41, formed is a motor unit central secured portion 41*a* which extends from the rear end of the central portion in the up-and-down direction toward the front in the fore-and-aft direction. At the motor unit central securing portion 41*a*, a central securing screw hole 41*b* is formed. On the right side of the upper part of the front side wall 39, a right cylindrical member through-hole 46 is formed. At the lower part of the front side wall 39, a crank-use through-hole 48 is formed. Around the crank use through-hole 48, formed is a crank use bearing supporting portion 39*d* which is an example of a cylindrical loosening member use bearing supporting portion which projects rearward. At the upper end of the front side wall 39, formed is an upper wall nipping portion 39*c* having a ⊃ shape in section projecting forward so as to correspond to the top wall 24 of the developer dropping frame 1. At the right end of the upper wall nipping portion 39*c*, formed is a right guide 39*a* which is an example of a guiding member extends downward in the up-and-down direction. The right guide 39*a*, which is guided in contact with the inner wall of the right upper wall 12, is formed in such a shape as to follow the inside face of the right upper wall 12. On the left side in the left-and-right direction of the front side wall 39, a left guide 39*b* having such a shape as to follow the left upper wall 14*a* is formed so as to be in contact with the inner face of the left upper wall 14*a* of the developer dropping frame 1.

On the right side of the front end of the upper wall 43, formed is a developer dropping frame 1-use secured portion 43*a* which projects upward oppositely to the upper unit secured portion 12*a*. At the developer dropping frame 1-use secured portion 43*a*, formed is an upper unit secured portion-use through-hole 43*b* which is an example of an upper developer dropping frame secured portion-use through-hole. On the left side of the rear end of the upper wall 43, formed is a motor unit secured portion 43*c* which is an example of a driving unit-use secured portion which projects upward. At the motor unit secured portion 43*c*, a screw hole 43*d* is formed.

On the lower face of the lower side wall 44, formed is a right lower guide 44*a* extending rearward from the lower end of the right guide 39*a*. On the lower face of the lower side wall 44, formed is a left lower guide 44*b* extending rearward from the lower end of the left guide 39*b*. At the rear end of the lower side wall 44, formed is a lower unit secured portion 44*c* projecting downward oppositely to the lower unit secured portion 22. On the other hand, at the lower unit secured portion 44*c*, formed is a lower unit secured portion-use through-hole 44*d* which is an example of a lower developer dropping frame secured portion-use through-hole. The couple of right and left lower guides 44*a*, 44*b* are formed so as to be in contact with the inner face of both right and left steps 12*b*, 18*a* formed by the right step 12*b* and the left step 18*a* in the developer dropping frame 1. Their length in the fore-and-after direction is made shorter than that of the right and left steps.

In the crank use through-hole 48, supported is a crank 51 which is an example of a rotating member, extending in the fore-and-aft direction through the bearing member 47. The crank 51 has a crank shaft 52 which is an example of a rotary center extending in the fore-and-aft direction. At the front end of the crank shaft 52, integrally formed is a first extension 53 having a shape bending outwardly in the radial direction. At the outer end in the radial direction of the first extension 53, integrally formed is a coil supporting portion 54 extending forward, which is an example of a loosening member supporting portion and also an example of a reciprocation applying portion. Namely, the coil supporting portion 54 is located at the position eccentric from the crank shaft 52 serving as the rotary center. At the front end of the coil supporting portion 54, integrally formed is a second extension 56 extending inwardly in the radial direction. At the inner end in the radial direction of the second extension 56, integrally formed is a front supported projection 57 coaxial to the crank shaft 52 which is an example of a supported portion extending forward.

Where the driving unit 37 is mounted in the developer dropping frame 1, the front supported projection 57 is fit in the front bearing 7*a* from behind and rotatably supported.

At the rear end of the crank shaft 52, secured is a crank gear 58 which is an example of a driven gear. The crank shaft 52 has a stopper 52*a* formed close to the front side of the crank use through-hole 48.

At the rear of the gear frame 38, supported is a motor unit 61 which is an example of an driving source unit. The motor unit 61 has a motor 62 which is an example of a driving source. At the front of the motor 62, supported is a plate-like motor unit frame 63 which is an example of a driving source unit frame. At the left upper end of the motor unit frame 63, formed is a motor unit securing portion 63*a* which is an example of a unit securing portion, opposite to the motor unit secured portion 43*c*. At the motor securing portion 63*a*, formed is a screw through-hole 63*b* corresponding to the screw hole 43*d*. Further, on the right side of the central portion in the up-and-down direction of the motor unit frame 63, formed is a central portion screw through-hole 63*c* corresponding to the central securing screw hole 41*b*.

In FIG. 5, a motor shaft 62*a* which is an example of the rotary shaft of the motor 62 passes through the motor unit frame 63 and extends forward. At the rear of the motor shaft 62*a*, supported is a driving gear 64 which is an example of a driving gear.

The driving gear 64 has a gear segment 66 arranged at the rear end, which is a cylindrical member having the motor shaft 62*a* as a central shaft and gear teeth formed on the outer periphery. At the front of the gear segment 66, integrally formed is a cylindrical spring seat 67 having a larger diameter than that of the gear segment 66. Within the spring seat 67, formed is a spring rear receiver 67*a* formed of a circular dent. At the inner end of the spring rear receiver 67*a*, integrally formed is a collar 68 which is an example of a cylindrical spring through-hole, extending forward along the motor shaft 62*a*.

At the front end of the collar 68, movably in the fore-and-aft direction supported is a driving side coupling 71 which is an example of a drive transmitting member. The driving side coupling 71 has a coupling body 72 arranged oppositely to the driven coupling 32. Within the coupling body 72, formed is a mesh 72*a* formed of a dent in mesh with the lug of the driven coupling 32. On the rear face of the coupling body 72, formed is a front spring supporting portion face 72*b*. On the front spring supporting portion face 72*b*, integrally formed is a front spring supporting portion 72*c* which is an example of a cylindrical front spring through-hole extending rearward. Between the front spring supporting portion face 72*b* and the spring rear end receiver 67*a*, mounted is a spring 73 which is an example of an urging member forward urging the driving side coupling 71 so as to cover the collar 68 and front spring supporting portion face 72*b*. The driving side coupling 71 is prevented from coming off by a stopper 74 supported at the front end of the motor shaft 62*a*. Therefore, by unit of urging by the spring 73, the driven coupling 32 and driving side coupling 71 surely mesh with each other. Thus, the motor shaft 62*a* and auger CLc2 are coupled with each other so that the rotation of the motor shaft 62*a* is transmitted to the auger CLc2.

Beneath the gear segment 66 of the driving gear 64, rotatably supported is an intermediate gear 76 which is an example of an intermediate gear. The intermediate gear 76 is in mesh with the gear segment 66 and crank gear 58. Therefore, when the motor 62 rotates, the crank gear 58 rotates through the driving gear 64 and intermediate gear 76 so that the rotation is transmitted to the crank 51.

At the merging transporting path-use detachable cover securing portion 23 at the lower end of the developer dropping unit 1, supported is a merging transporting path use detachable cover 83 which is an example of a merging transporting path-use detachable member. The merging transporting path use detachable cover 83 has a detachable cover body 84 extending in the up-and-down direction. At the upper end of the detachable cover body 84, formed is a cover upper through-hole 84*d* which is an example of an upper covering member securing through-hole, corresponding to the cover-use upper end screw hole 23*a*. At the lower part of the detachable cover body 84, formed is a transporting path supporting portion 84*a* formed along the rear outer periphery of the merging transporting path UH2. At the lower end of the detachable cover body 84, formed is a cover lower end through-hole 84*f* which is an example of a lower covering member securing through-hole, corresponding to the lower cover securing screw 8*a*. Therefore, with the merging transporting path UH2 supported by the front merging transporting path receiving portion 8, by securing the detachable cover body 84 by the cover upper through-hole 84*d* and cover lower through-hole 84*f*, the merging transporting path UH2 and the developer dropping unit 1 are mounted.

At the front supported projection 57 of the crank 51, supported is a swinging member 77 which is an example of an loosening member. The swinging member 77 has a swinging board 78 which is an example of a loosening member body, extending along the front inclining wall inner face 7*b* which is an example of an inner face of the front inclining wall 7.

The lower part of the swinging board 78 has a width narrowing downward in the right-and-left direction.

The position of the upper end of the swinging board 78 is located at an upper position in the up-and-down direction than the position where the region resulting when the residue dropping opening 29 is projected downward in a direction of gravity crosses the front inclining wall 7. Namely, where the swinging member 77 is reciprocated, the upper end in the direction of gravity of the swinging board 78 is always located at an upper position in the direction of gravity than the position where a line L11 drawn vertically from the residue dropping opening 29 crosses the swinging board 78.

At the central portion in the right-and-left direction of the upper part of the swinging board 78, formed is a rectangular hole-like swinging crank through-hole 79 which is an example of a through-hole longer in the left-and-right direction which. The front supported projection 57 of the crank 51 passes through the swinging crank through-hole 79. The swinging member 77 is supported swingably in the left-and-right direction along the swinging crank through-hole 79 from the front supported projection 57. In Embodiment 1, where the swinging member 77 is reciprocated, the lower end in the direction of gravity of the swinging crank through-hole 79 is always located at an upper position in the direction of gravity than the position where the line L11 drawn vertically from the residue dropping opening 29 crosses the swinging board 78.

The swinging board 78 has crank contacts 81*a*, 81*b* which are an example of a pair of left and right reciprocation applied segments, formed so as to cross the swinging crank through-hole 79. In Embodiment 1, the interval between the crank contacts 81*a* and 81*b* is set so as to be narrower than the rotating diameter of the coil supporting portion 54.

The coil supporting portion 54 supports a coil spring 82 formed of a wire helically shaped so as to be rotatable at the upper end, which is an example of a second loosening member.

Operation of Embodiment 1

In the image forming apparatus U3 according to Embodiment 1 having the above configuration, with an image forming operation, the waste toner is exhausted from the developing device Gy, Gm, Gc, Gk and the residue is recovered by the cleaner CLy, CLm, CLc, CLk. The residue recovered by the cleaner CLy, CLm, CLc, CLk is transported by the augers Cly2 to CLk2 to the developer dropping unit UH11 to UH16 at the rear to flow in from the cleaner transporting path through-hole 4*a*. The waste toner exhausted from the developing device Gy, Gm, Gc, Gk flows into the developer dropping frame 1 from the developing device use transporting path through-hole 4*b* by driving the corresponding deteriorated developer transporting member G3*k*.

The residue within the residue transporting cylinder CLc3 flowed into the developer dropping frame 1 drops on the swinging board 78 downward in the direction of gravity from the residue dropping opening 29 and further drops along the slope to the merging transporting path UH2 to be transported. The residue within the developing device use transporting cylinder G4*k* flowed into the developer dropping frame 1 drops from the developer dropping opening 36 and further drops along the swinging board 78 to the merging path UH2.

Thus, the residue or waste developer such as the waste toner flowed into the developer dropping unit UH11 to UH16 flows into the merging transporting path UH2 and is transported to the developer recovering vessel UH6 through the dropping direction transporting path UH3 and vessel transporting path UH4, thereby being recovered.

Figure 7A:
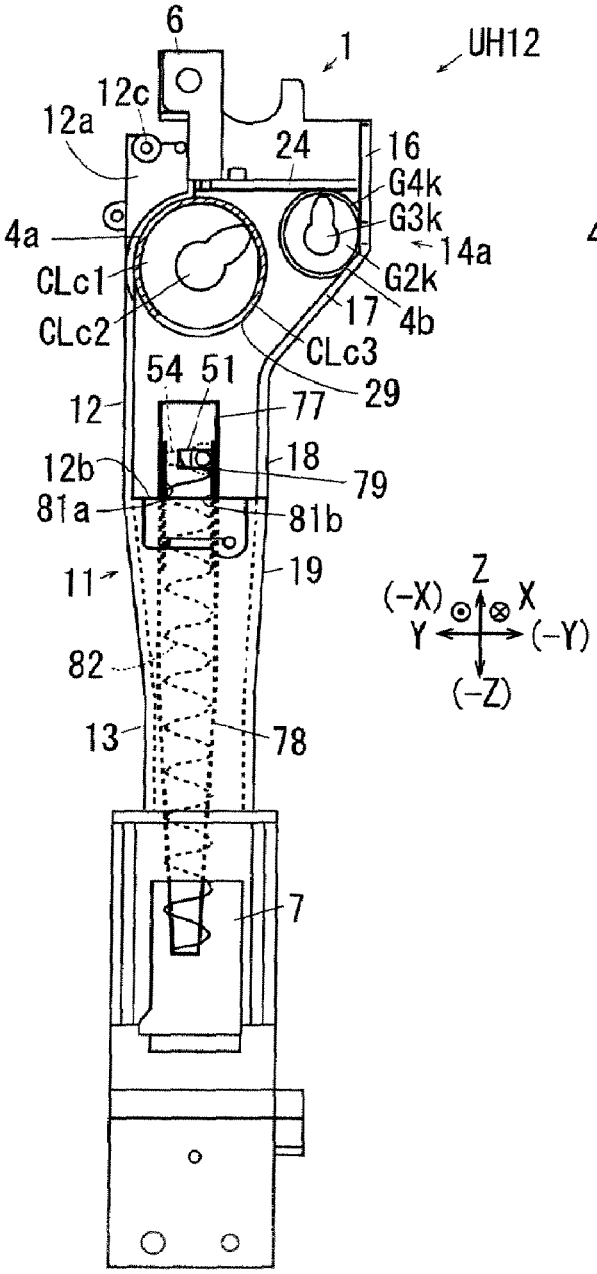
FIGS. 7A and 7B are views for explaining the operation of the swinging member in Embodiment 1.
Figure 7B:
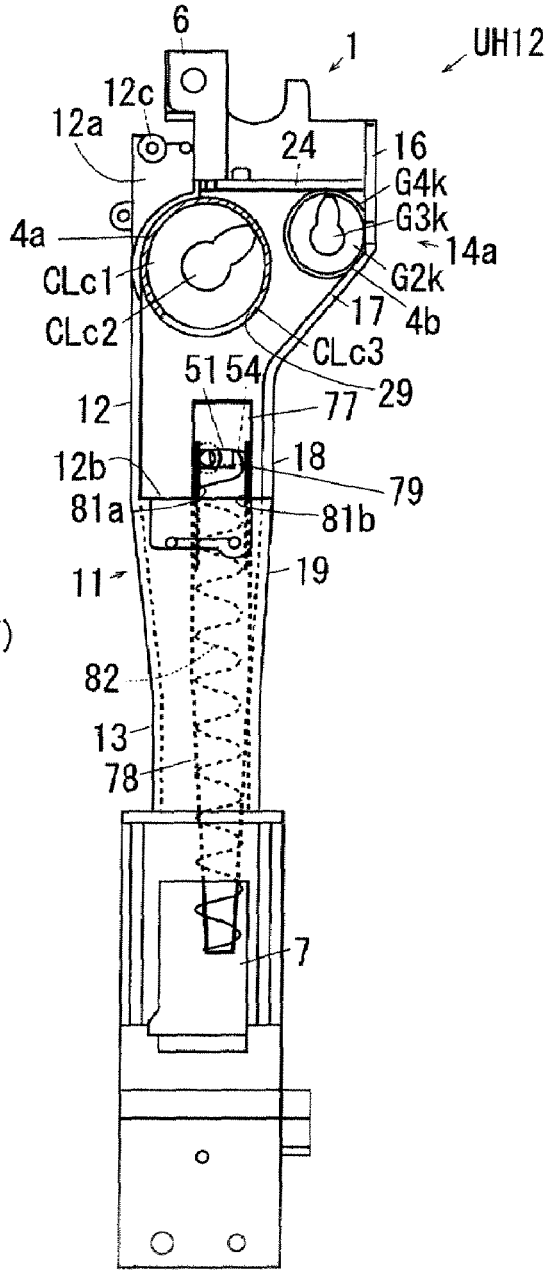

FIG. 7 is a view for explaining the operation of the swinging member in Embodiment 1. FIG. 7A is a view for explaining the state when the swinging member moved rightward, or toward +Y direction. FIG. 7B is a view for explaining the state when the crank rotates 180° from the state of FIG. 7A so that the swinging member moved leftward, toward −Y direction.

In the developer dropping unit UH12 in Embodiment 1, the developer flowed into the developer dropping frame 1 drops on the upper surface of the swinging board 78 of the swinging member 77. In FIG. 7, the swinging member 77 has the same driving source as those for the cleaner CLy2, CLm2, CLc2, CLk2. By the coil supporting portion 54 of the crank 51 which is rotated by the motor 62, the crank contacts 81*a*, 81*b* are periodically pushed so that they swing in the left-and-right direction along the swinging crank through-hole 79.

Therefore, the swinging member 77 swings to demolish the developer which tends to be solidified or deposited in the developer dropping frame 1. Particularly, as compared with the case where the developer drops vertically, the developer in a high temperature/high humidity environment which tends to be solidified or deposited in the inclining dropping transporting path within the developer dropping frame 1 is demolished, thereby reducing the jamming of the developer.

Now, the swinging member 77 in Embodiment 1 swings not in the up-and-down direction along the dropping transporting direction but in the left-and-right direction perpendicular to the dropping transporting direction, thereby reducing the scattering or floating of the developer within the developer dropping frame 1 as compared with the case where the swinging member moves upward oppositely to the dropping direction. Namely, by swinging the swinging member in the right-and-left direction, upward scattering or floating of the residue dropping from the residue dropping opening 29 is suppressed. Thus, the solidification or deposition of the toner on the inner wall of the transporting body to generate jamming of the developer is reduced, thereby reducing the dirt due to leakage of the developer.

Further, in Embodiment 1, since the upper end of the swinging board 78 is located above the position where the residue drops from the residue dropping opening 29, the deposition of the residue at the dropping position is prevented; and the developer is not prone to enter the gap between the swinging board 78 and the front side inclining wall 7 and the developer entered is not prone to be rubbed and applied on the front side inclining wall 7.

Further, in Embodiment 1, since the swinging member 77 is arranged along the front side inclining wall 7 inclining with respect to the direction of gravity, by gravity, the swinging member 77 is subjected to the force of the component in the direction approaching the front side inclining wall 7. Therefore, as compared with the case where the swinging member in Embodiment 1 is subjected to the force of the component in the direction leaving the front side inclining wall 7, during swing, the swinging member 77 is not prone to be separated from the front side inclining wall 7 and the developer is not prone to enter between the swinging member 77 and the front side inclining wall 7.

In the developer dropping unit UH12 in Embodiment 1, the coil spring 82 is supported by the coil supporting portion 54 so that the coil spring 82 makes a periodic vibration on the swinging board 78 according to the rotation of the coil supporting portion 54 eccentric from the rotary center of the crank 51. For this reason, in Embodiment 1, the developer is more effectively demolished and scraped off downward owing to the vibration of the coil spring 82 as well as the swing of the swinging member 77, thereby further reducing jamming with the developer.

In the developer dropping unit UH12 in Embodiment 1, the crank 51, gear frame 38, swinging member 77, coil spring 82 are united as the gear unit 37*a* which is integrally detachable from the developer dropping frame 1. The motor unit 61 is integrally detachably supported in the gear unit 37*a*. Thus, attachment/detachment among the developer dropping frame 1, gear unit 37*a* and motor unit 61 is facilitated, thereby giving the configuration facilitating assembling or maintenance of the developer dropping unit UH12 and its dismantling in the replacement of worn components.

Embodiment 2

Figure 8:
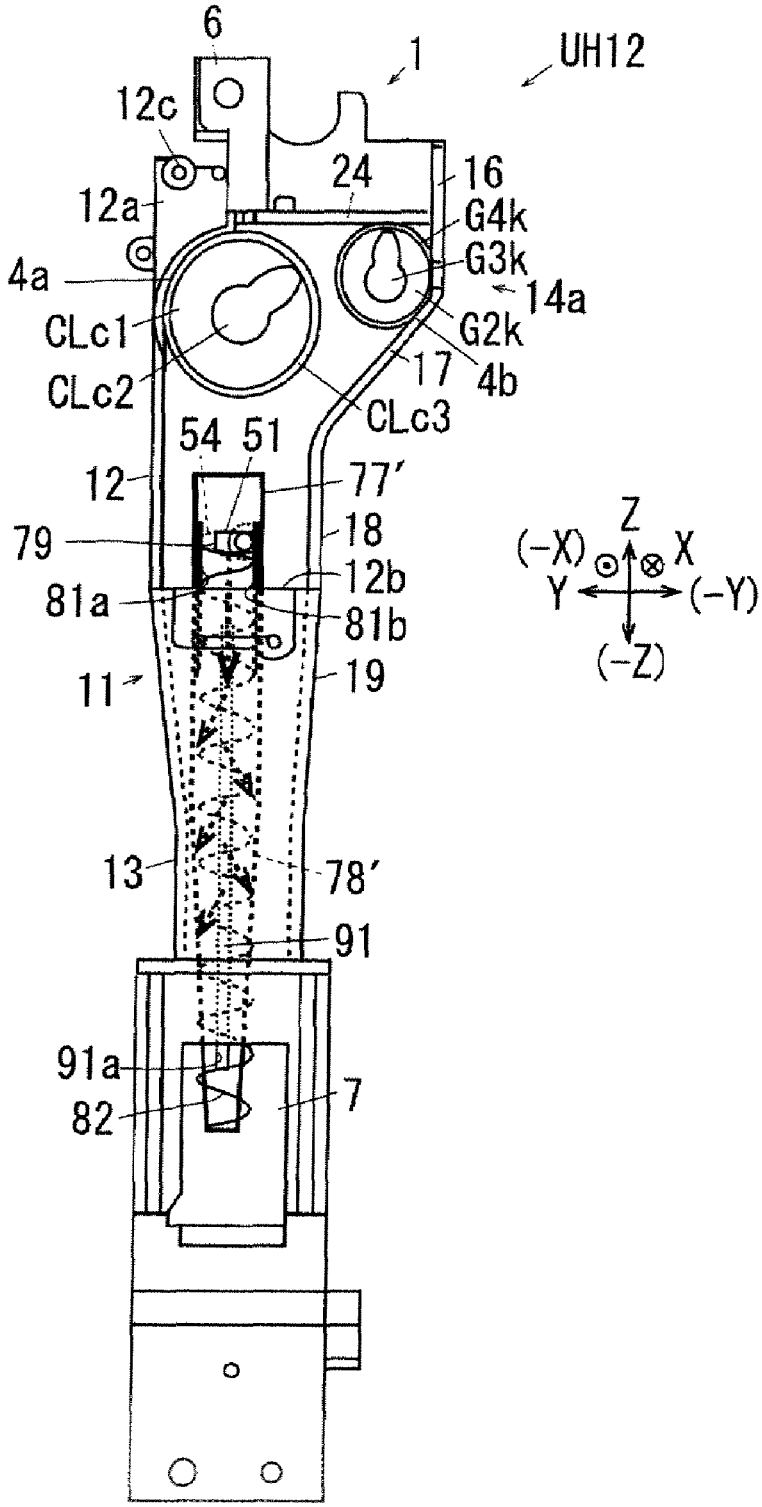
FIG. 8 is a view for explaining the swinging member 79 according to Embodiment 2 corresponding to that according to Embodiment 1 in FIG. 7.

FIG. 8 is a view for explaining the swinging member 79 according to Embodiment 2 corresponding to that according to Embodiment 1 in FIG. 7.

Next, Embodiment 2 will be explained. In this explanation, like reference symbols refer to like elements in those in Embodiment 1 and will be not explained in detail.

Embodiment 2 is different from Embodiment 1 in the following points, but in other points, constructed similarly to Embodiment 1.

In FIG. 8, in a swinging member 77' according to Embodiment 2, at the central position in the right-and-left direction of a swinging board 78' thereof, formed is a slit 91 which is an example of a developer exit extending in the up-and-down direction. In Embodiment 2, where the swinging member 77' is reciprocated, the upper end in the direction of gravity of the slit 91 is always located at a lower position in the direction of gravity than the position where the line L11 drawn vertically from the residue dropping opening 29 crosses the front side inclining wall 7.

Operation of Embodiment 2

In the developer dropping unit UH12 according to Embodiment 2 having the above configuration, where the swinging member 77' is swung, even when the developer enters the gap between the swinging board 78' and the front inclining wall 7 from the swinging crank through-hole 79 or the upper end of the swinging board 78, it passes from the front of the swinging board 78' to the rear thereof through the slit 91. Particularly, a peripheral edge 91*a* of the slit 91 serving as a scraping-off portion is formed at a position overlapping the swinging crank through-hole 79 in the direction of gravity. By the peripheral edge 91*a*, the developer entered from the swinging crank through-hole 79 and rubbed on the front side inclining wall 7 are scraped off and exhausted through the slit 91.

Thus, in Embodiment 2, it is possible to suppress obstruction of the swinging of the swinging member 77' and jamming of the developer as a result that the developer enters the gap between the swinging member 77' and the front side inclining wall 7 and is solidified or deposited.

Embodiment 3

Figure 9A:
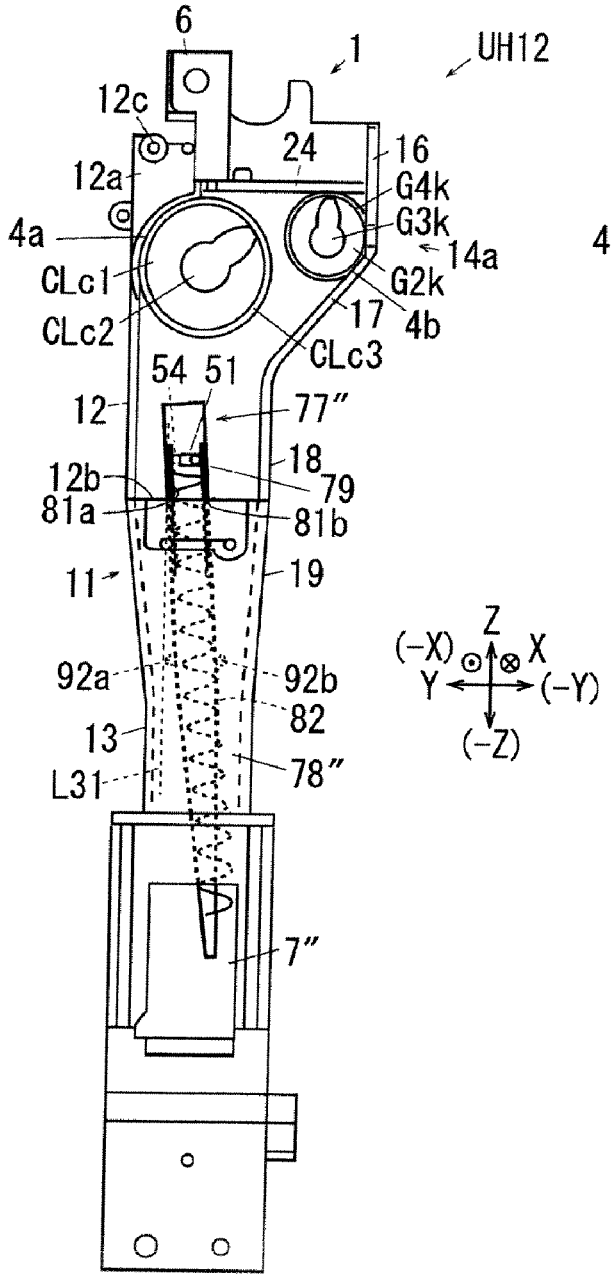
FIGS. 9A and 9B are views for explaining a swinging member according to an exemplary Embodiment 3 of this invention corresponding to that according to Embodiment 1 in FIG. 7.
Figure 9B:
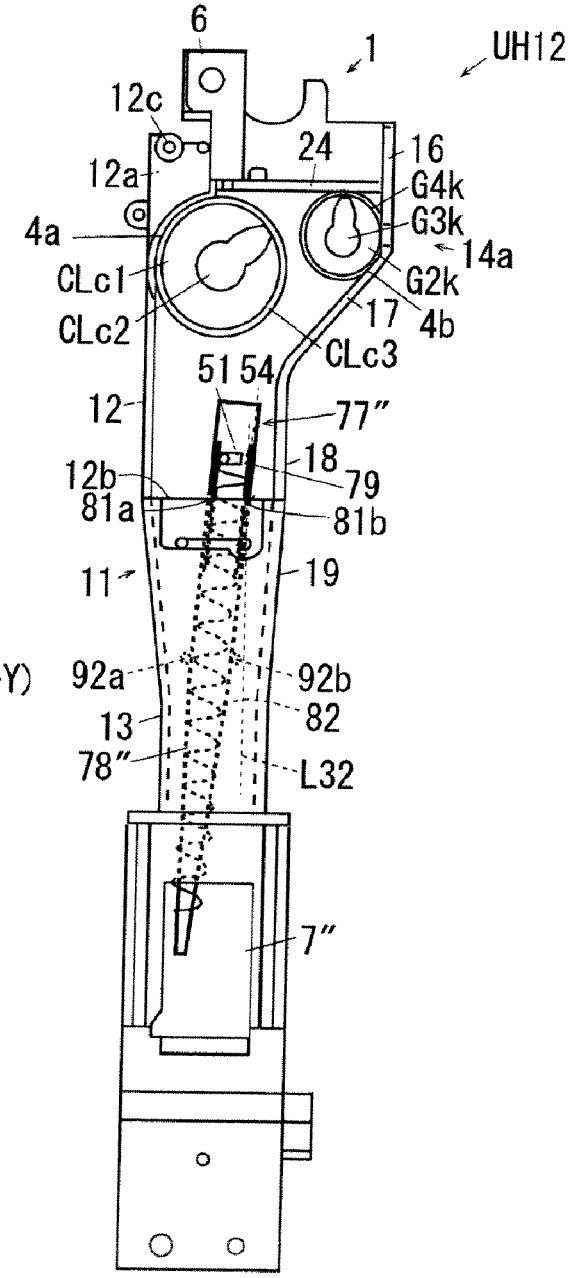

FIG. 9 is a view for explaining a swinging member according to Embodiment 3 corresponding to that according to Embodiment 1 in FIG. 7. FIG. 9A is a view for explaining the state when the swinging member moved rightward; and FIG. 9B is a view for explaining the state when the crank rotates 180° from the state of FIG. 9A so that the swinging member moved leftward.

Next, Embodiment 3 will be explained. In this explanation, like reference symbols refer to like elements in those in Embodiment 1 and will be not explained in detail.

Embodiment 3 is different from Embodiment 1 in the following points, but in other points, constructed similarly to Embodiment 1.

In FIG. 9, beneath the front bearing 7*a* of the a front side inclining wall 7" in Embodiment 3, supported are a right stopper 92*a* and a left stopper 92*b* are an example of a pair of left and right movement limiting members so as to sandwich the swinging member 77". In Embodiment 3, the right stopper 92*a* and the left stopper 92*b* are located on the arranging side of the crank shaft 52 serving as a rotary center with respect to the plane of lines L31, L32 drawn vertically from the outer ends in the horizontal direction of the range where the contacts between the coil supporting portion 54 which is an example of a reciprocation applying portion and the crank contacts 81*a*, 81*b* which is an example of a reciprocation applied portion move.

Operation of Embodiment 3

In the developer dropping unit UH12 according to Embodiment 3 having the above configuration, when the swinging member 77" suffers the swinging force in the right-and-left direction by the rotation of the crank 51, the movement of the swinging member 77" is limited by the stoppers 92*a*, 92*b*. Thus, at a fulcrum in contact with the right stopper 92*a* displaced downward from the front bearing 7*a*, as shown in FIGS. 9A and 9B, the upper part and lower part of the swinging member 77" with respect to the right stopper 92*a* swing oppositely to each other.

Accordingly, in the developer dropping unit UH12 in Embodiment 3, as compared with case where the swinging member 77 swings simply in the left-and-right direction as in Embodiments 1 and 2, complicated swinging is generated, thereby reducing jamming of the developer like Embodiments 1 and 2.

Embodiment 4

Figure 10A:
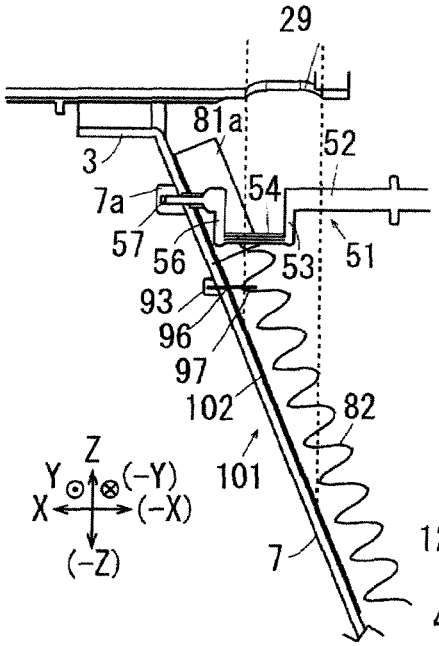
FIGS. 10A and 10B are views for explaining a swinging member according to an exemplary Embodiment 4 of this invention corresponding to that according to Embodiment 1 in FIG. 7.
Figure 10B:
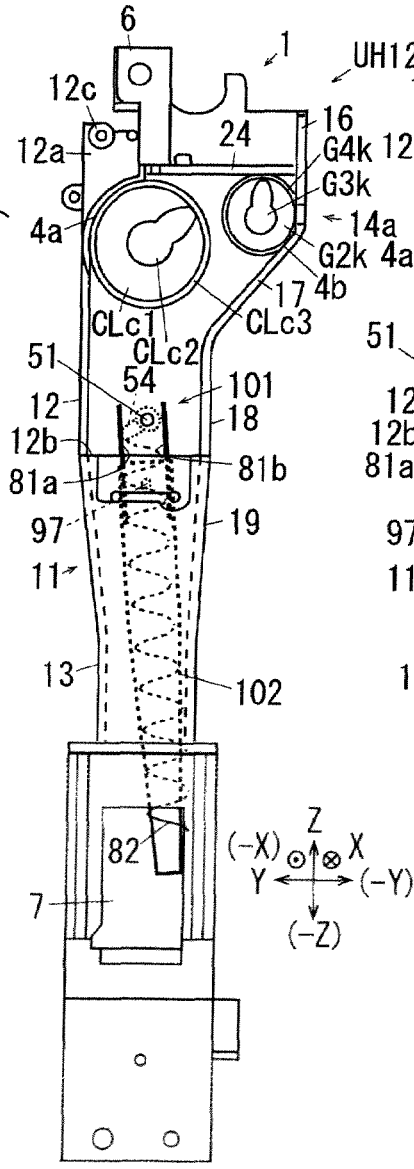
Figure 10C:
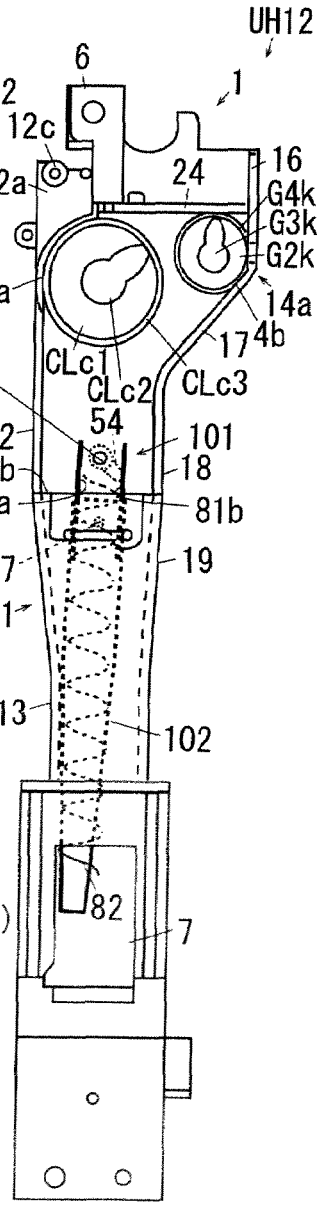
FIG. 10C is a view for explaining the state when the crank rotates 180° from the state of FIG. 10B so that the swinging member moved leftward.

FIG. 10 is a view for explaining a swinging member according to an exemplary Embodiment 4 of this invention corresponding to that according to Embodiment 1 in FIG. 7. FIG. 10A is a lateral view for explaining a developer dropping unit according to Embodiment 4, FIG. 10B is a view for explaining the state when the swinging member moved rightward; and FIG. 10C is a view for explaining the state when the crank rotates 180° from the state of FIG. 10B so that the swinging member moved leftward.

Next, Embodiment 4 will be explained. In this explanation, like reference symbols refer to like elements in those in Embodiment 1 and will be not explained in detail.

Embodiment 4 is different from Embodiment 1 in the following points, but in other points, constructed similarly to Embodiment 1.

In FIG. 10, beneath front bearing 7*a*, formed is a concave swinging member supporting hole 93 which is an example of a supporting piece.

In Embodiment 4, a swinging member 101 is provided in place of the swinging member 77 according to Embodiment 1. A swinging board 102 thereof has, in place of the swinging crank through-hole 79 in Embodiment 1, a long-hole like swinging member supporting pin use through-hole 96 longer in the left-and-right direction which is an example of a supported piece arranged at the position corresponding to the swinging member supporting hole 93. Therefore, unlike Embodiment 1, the swinging member 101 according to Embodiment 4 is not supported by the crank 51 but supported by a supporting pin 97 which is an example of a supporting member, passing through the swinging member supporting pin use through-hole 96 and supported by the swinging member supporting portion 93.

Further, unlike the swinging board 78 in Embodiment 1, the swinging board 102 in Embodiment 4 is formed to have such a length that its upper end is located beneath the front bearing 7*a* and at an upper position than the position where the region when the residue dropping opening 29 is projected downward in a direction of gravity crosses the front inclining wall 7. In Embodiment 4, the crank contact 81*a*, 81*b* is formed in a shape protruding upward from the upper end of the swinging board 102 and located above the swinging member supporting hole 93 in the direction of gravity. Namely, in Embodiment 4, the crank shaft 52 and the swinging member supporting hole 93 are arranged at positions overlapping each other along the direction of gravity, and the swinging member supporting hole 93 and the crank contacts 81*a*, 81*b* are arranged at positions not crossing each other along the direction of gravity, at different heights.

Operation of Embodiment 4

In the developer dropping unit UH12 in Embodiment 4 having the above configuration, the swinging member 101 is swingably supported by the supporting pin 97 along the swinging member supporting pin use through-hole 96. Further, the swinging member 101 is swung in the left-and-right direction by the rotation of the crank 51 arranged above the swinging member 101.

Thus, in Embodiment 4, since the supporting portion and rotary shaft are different, the swinging member 101 can be supported with less rattle for the front inclining wall 7 and during the swing, the swinging member 101 can be made more difficult to leave the front inclining wall 7. Thus, it is possible to reduce the application or deposition of the developer in the gap between the swinging member 101 and the front inclining wall 7. Like Embodiments 1 to 3, jamming of the developer can be reduced.

Embodiment 5

Figure 11A:
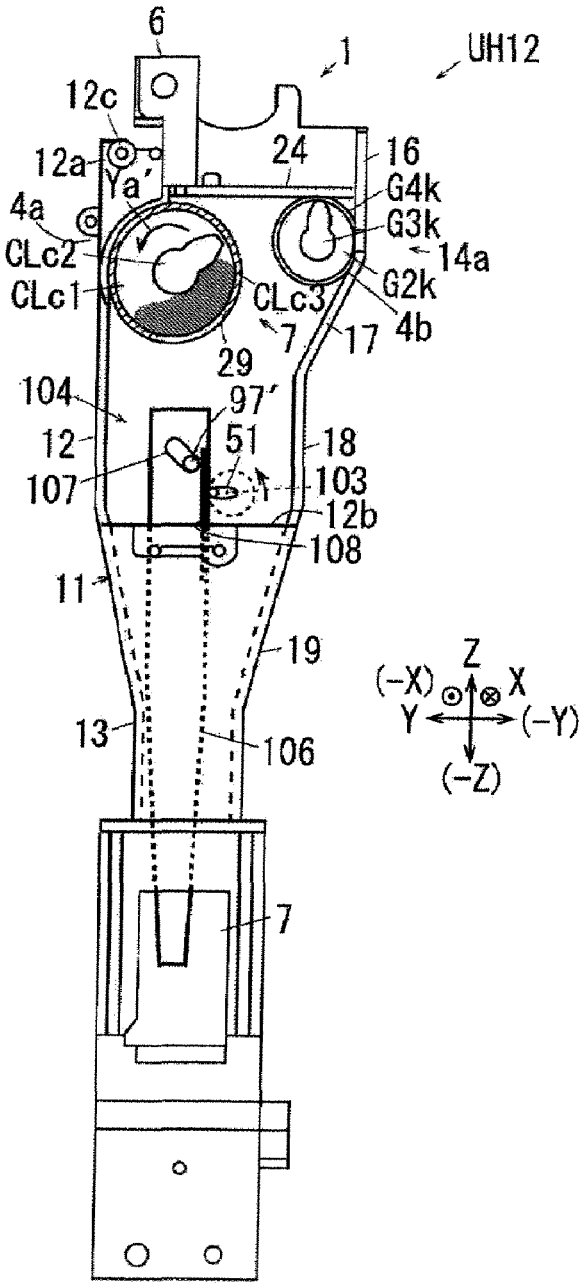
FIGS. 11A and 11B are views for explaining a swinging member according to an exemplary Embodiment 5 of this invention corresponding to that according to Embodiment 1 in FIG. 7.
Figure 11B:
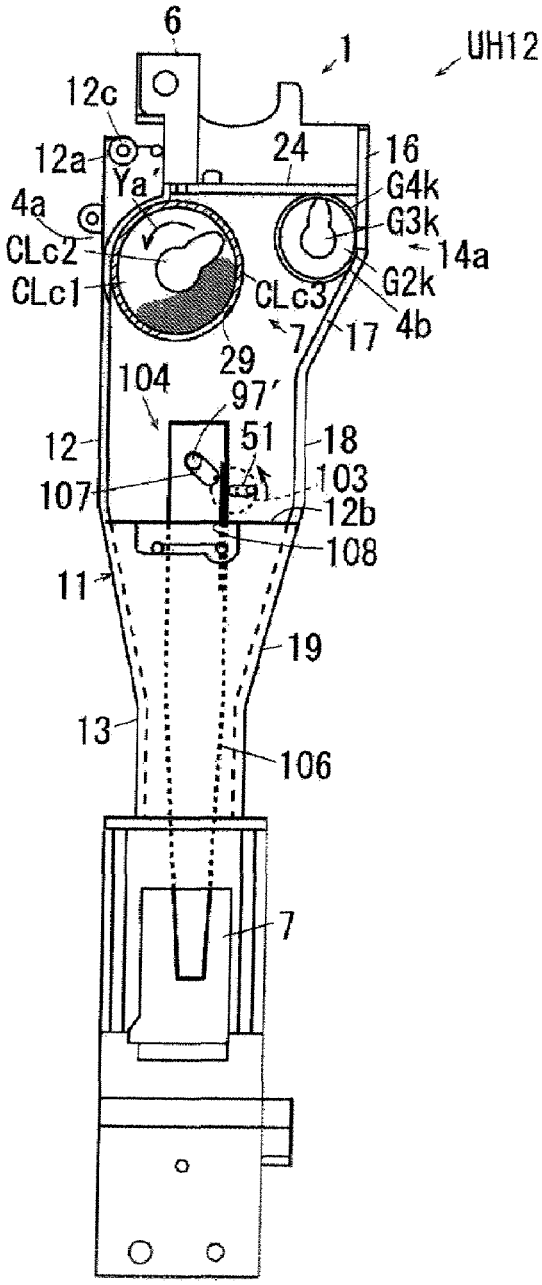

FIG. 11 is a view for explaining a swinging member according to an exemplary Embodiment 5 of this invention corresponding to that according to Embodiment 1 in FIG. 7. FIG. 11A is a view for explaining the state when the swinging member moved rightward; and FIG. 11B is a view for explaining the state when the crank rotates 180° from the state of FIG. 11A so that the swinging member moved leftward.

Next, Embodiment 5 will be explained. In this explanation, like reference symbols refer to like elements in those in Embodiments 1, 4 and will be not explained in detail.

Embodiment 5 is different from Embodiments 1, 4 in the following points, but in other points, constructed similarly to Embodiments 1, 4.

Referring to FIG. 11, on the front inclining wall 7 in Embodiment 5, unlike the front bearing 7*a* in Embodiment 1 to Embodiment 4, a front bearing 103 is formed on the left upper side of the front inclining wall 7, i.e. at the position displaced toward −Y and +Z.

Right above the front bearing 103, formed is a concave swinging member supporting hole 93' which is an example of the supporting piece. The swinging member supporting hole 93' is located at a position near the side when the auger CLc2 rotates in the upward direction from below in the direction of gravity for the residue dropping opening 29. The interval between the front bearing 103 and the swinging member supporting hole 93' is set to be longer than the rotating radius of the coil supporting portion 54 of the crank 51.

In Embodiment 5, a swinging member 104 is provided in place of the swinging member 77 in Embodiment 1. Instead of the swinging member supporting pin use through-hole 96 in Embodiment 4, the swinging board 106 of the swinging member 104 has a longish hole-like swinging member supporting pin-use inclining through-hole 107 extending from the left lower side to right upper side which is an example of a supported member arranged at the position corresponding to the swinging member supporting hole 93'. The swinging board 106 is swingably supported by a supporting pin 97' along the swinging member supporting pin-use inclining through-hole 107 from the left lower side to the right upper side, i.e. in the direction obliquely crossing the dropping direction. In Embodiment 5, even when the swinging board 106 is located at the most left position, the upper end of the swinging member 104 is located at an upper position than the position where the region when the residue dropping opening 29 is projected downward in a direction of gravity crosses the front inclining wall 7. In Embodiment 5, as compared with the case of Embodiment 1, the residue dropping opening 29 is formed at the position approaching the left side and toward −Y side.

In the swinging board 106 in Embodiment 5, unlike Embodiments 1, 4, a left crank contact 108 is formed on only the left side of the swinging member supporting pin use inclining through-hole 107. Further, the coil supporting portion 54 of the crank 51 is brought into contact with the left crank contact 108 from the left upper side of the swinging board 106, i.e. from the −Y and +Z side.

Operation of Embodiment 5

In the developer dropping unit UH12 according to Embodiment 5 having the above configuration, as shown in FIG. 11A, when the coil supporting portion 54 moves more leftward than the crank 51, the coil supporting portion 54 and the left crank contact 108 do not become in contact with each other so that the swinging member 104 moves owing to gravity toward the left lower side along the swinging member supporting pin-use inclining through-hole 107.

Further, as shown in FIG. 11B, when the coil supporting portion 54 moves more rightward than the crank 51, the coil supporting portion 54 and the left crank contact 108 are brought into contact with each other so that the swinging member 104 is pushed rightward, i.e. +Y direction. Therefore, the swinging member 104 moves toward the right upper side along the swinging member supporting pin use inclining through-hole 107. Referring to FIG. 11, in Embodiment 5, the auger CLc2 rotates in the direction of an arrow Ya' so that the residue transported along the residue transporting path CLc1 is likely to be drawn toward the left side downstream of the rotation. Thus, the quantity of the residue dropping from the residue dropping opening 29 is larger on the left side of the residue dropping opening 29 than on the right side thereof.

In Embodiment 5, on the left side where the dropping quantity of the residue is larger, i.e. the auger Crc2 rotates in an upward direction from below in the direction of gravity, the swinging member 104 moves from the right upper side toward the left lower side. Therefore, the swinging member 104 moves in an obliquely downward direction having a downward component in the direction of gravity so that it assists the drop of the residue by the force of its downward movement as well as the gravity. On the other hand, on the right side where the dropping quantity of the residue is smaller, the swinging member 104 moves from the left lower side toward the right upper side so that the scattering or floating of the residue generated due to the upward movement of the swinging member 104 is suppressed to the lowest limit. Further, on the side where the dropping quantity of the residue is larger, the swinging member supporting hole 93' is arranged so that the swinging member 104 is reciprocated mainly on this side. Thus, as compared with the case where the swinging member supporting hole 93' is arranged on the side where the dropping quantity of the residue is smaller, the demolishing capability is improved.

Further, in Embodiment 5, like Embodiment 4, since the supporting portion is different from the rotary shaft, the swinging member 104 can be supported against the front inclining wall 7 with no rattling. Thus, the swinging member 104 can be made more difficult to leave the front inclining wall 7. So, it is possible to reduce the application or deposition of the developer in the gap between the swinging member 104 and the front inclining wall 7. Like Embodiments 1 to 4, jamming of the developer can be reduced.

Further, in Embodiment 5, the coil supporting portion 54 moves in contact with the left crank contact 108 from above so that the swinging member 104 is pushed by the force applied downward from above while it moves in the right upper direction. Thus, the swinging member 104 suffers the force in the direction component being pushed against the front inclining wall 7. As a result, the swinging member 104 is difficult to leave the front inclining wall 7 and suffers the force from, the front inclining wall 7 side by gravity while it moves in the left lower side. As a result, the swinging member 104 is reciprocated without suffering the force in the direction leaving the front inclining wall 7.

Embodiment 6

Figure 12B:
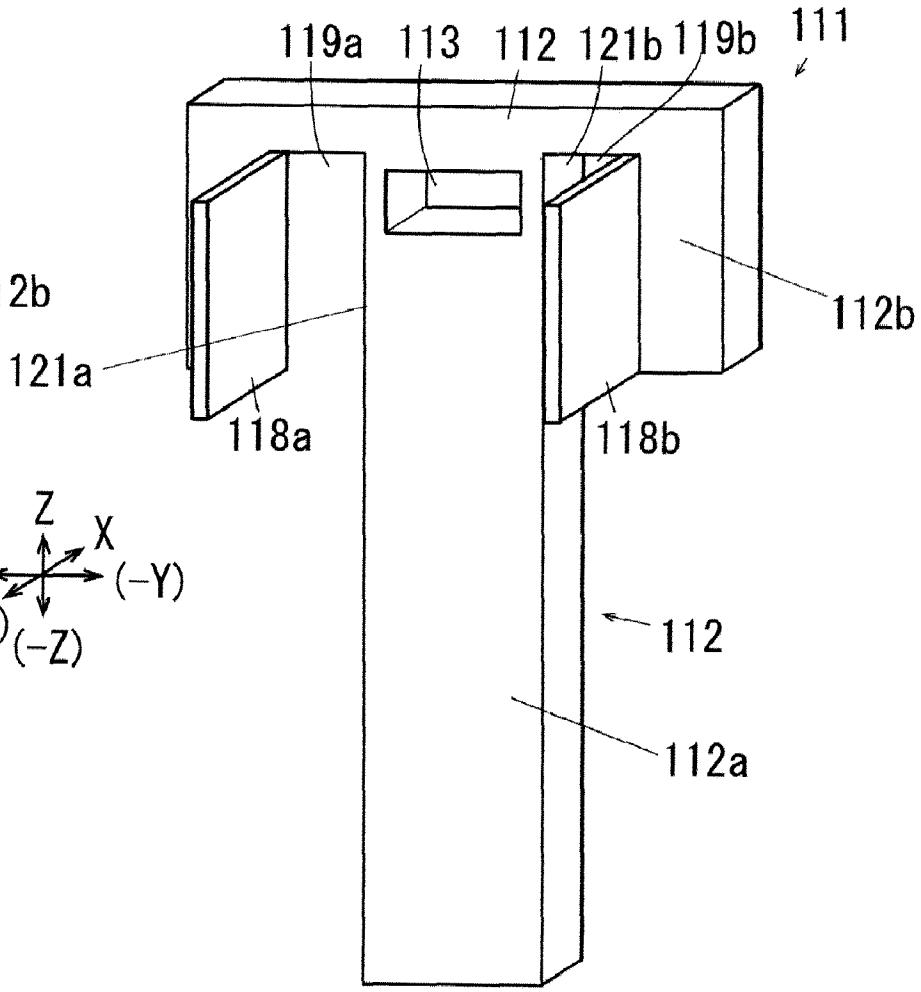
FIGS. 12A and 12B are views for explaining the swinging member according to Embodiment 6.
Figure 12A:
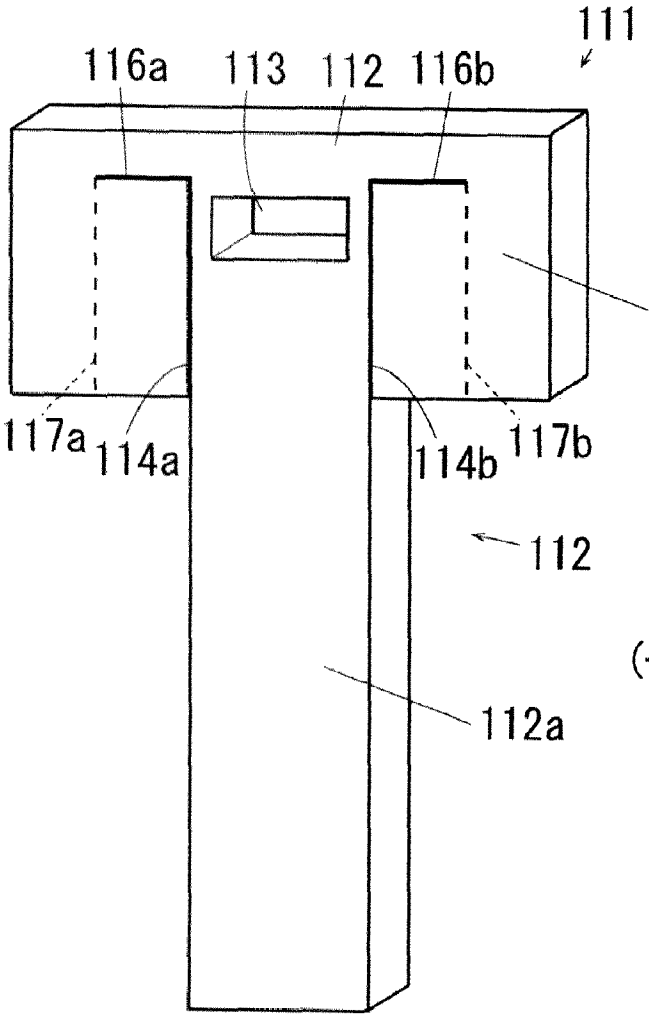

FIG. 12 is a view for explaining the swinging member according to Embodiment 6. FIG. 12A is a view before a crank contact of the swinging member is formed. FIG. 12B is a view after a crank contact of the swinging member has been formed.

Referring to FIG. 12, a swinging member 111 in Embodiment 6 has a swinging board 112. The swinging board 112 is integrally formed of a swinging board lower component 112*a* extending in the up-and-down direction and a swinging board upper component 112*b* wider in the left-and-right direction than the upper end of the swinging board lower component 112*a*. At the central position in the left-and-right direction of the upper part of the swinging board upper component 112*b*, formed is a swinging crank through-hole 113 which is an example of a supported portion.

Referring to FIG. 12A, in the swinging board upper component 112*b* before the crank contact is formed, on the extending lines of both left and right side edges of the swinging board lower component 112*a*, a pair of left and right vertical cuts 114*a*, 114*b* are formed to the height position of the upper edge of the swinging crank through-hole 113. In the swinging board upper component 112*b*, a pair of left and right horizontal cuts 116*a*, 116*b* are formed from the upper edges of the vertical cuts 114*a*, 114*b* outwardly in the left-and-right direction.

Referring to FIGS. 12A and 12B, in the swinging member 111 in Embodiment 6, the areas encircled by the vertical cuts 114*a*, 114*b* and the horizontal cut 116*a*, 116*b* shown in FIG. 12A are folded up from the outer edges of the horizontal cuts 116*a*, 116*b* to the lower end of the swinging board upper component 112*b* on the lower side in the direction of gravity along valley-folding lines 117*a*, 117*b* extending downward in the direction of gravity. Thus, crank contacts 118*a*, 118*b* as shown in FIG. 12B which are an example of a pair of reciprocation applied members are formed. As a result, in the state where the crank contacts 118*a*, 118*b* are folded to be upright, scraping-off slits 119*a*, 119*b*, which are an example of a pair of left and right invader spitting members, are formed between the bases of the crack contacts 118*a*, 118*b* and the vertical cuts 114*a*, 114*b*. Further, by the edges of the vertical cuts 114*a*, 114*b* side of the scraping-off slits 119*a*, 119*b*, scraping-off edges 121*a*, 121*b* which are an example of scraping off members are formed.

Operation of Embodiment 6

In the developer dropping unit UH12 according to Embodiment 6 having the above configuration, the dropping residue may enter the gap between the swinging board 112 and the front inclining wall 7 through the swinging crank through-hole 113 so that the residue entering from the swinging crank through-hole 113 may be rubbed on the front inclining wall 7 by the swinging member 111. On the other hand, in the swinging member 111 in Embodiment 6, while the swinging member 111 swings, by the scraping-off edges 121*a*, 121*b* of the scraping-off slits 119*a*, 119*b* formed to the positions horizontally overlapping the swinging crank through-hole 113, i.e. to the height of the swinging crank through-hole 113, the rubbed residue is scraped off and drops downward through the scraping-off slits 119*a*, 119*b*. Therefore, as compared with the case where the scraping-off edges 121*a*, 121*b* are not provided, solidification or deposition of the residue entering from the swinging crank 113 is reduced.

(Modification)

The explanation has been given of the various embodiments hitherto. However, this invention should not be limited to the above embodiments, but can be modified in various manners within a scope not departing from the sprit of the invention defined in claims. Typical modifications (H01) to (H04) of this invention will be listed below.

(H01) In the above embodiments, a copier U has been adopted as an example of the image forming apparatus. Without being limited to this, this invention can be applied to a printer, facsimile, or a composite machine having these plural functions. Further, this invention should not be limited to the multiple-developing image forming apparatus, but can be also applied to a monochromatic image forming apparatus. Further, this invention should not be limited to a tandem-type image forming apparatus, out can be also applied to a rotary-type image forming apparatus.

(H02) In the above embodiments, the augur CLc2 and crank 51 were driven by the motor 62, and the deteriorated developer transporting member G3*k* was driven by the driving motor not shown of the developing device Gk. However, without being limited to this, the auger CLc2 and the deteriorated developer transporting member G3*k* may be driven by a common driving motor. Inversely, the respective rotary members, i.e. the augur CLc2, crank 51 and the deteriorated developer transporting member G3*k* may be driven by individual motors.

(H03) In the above embodiments, the coil spring 82 formed of a wire helically shaped, which is an example of a second loosening member, was supported by the coil supporting portion 54 so as to be rotatable at the upper end. However, the second loosening member should not be limited to the shape of the coil spring and may be formed in any shape. For example, a blush-like cleaning member may be connected to the coil supporting portion 54 by an elastic member of e.g. rubber. The coil spring 82 is desirably provided, but can be omitted.

(H04) In the above embodiments, the swinging member 77 was provided in the developer dropping unit UH12. However, the transporting path to be arranged should not be limited to the developer dropping unit UH12, but the swinging member 77 may be arranged in any of other dropping transporting paths, e.g. dropping direction transporting path UH3.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A powder transporting device comprising:

a dropping path through which powder drops;

a loosening member that is arranged in the dropping path, and loosens the powder applied on an inner wall of the dropping path;

a supporting portion that is provided on the inner wall of the dropping path, and supports the loosening member;

a rotary member that includes:

a rotary center; and a reciprocation applying portion that is located at a position eccentric from the rotary center, the rotary member being arranged within the dropping path and rotationally driven; and a pair of reciprocation applied portions that are provided in the loosening member, and are brought into contact with the reciprocation applying portion, wherein the loosening member moves to the left and to the right of the rotary center orthogonal to a longitudinal axis of the dropping path along the inner wall of the dropping path by contact between the reciprocation applying portion and the pair of reciprocation applied portions while the rotary member rotates, wherein the loosening member includes a flat surface on which the powder drops, the loosening member moving to the left and the right of the rotary center in the same plane that the fiat surface lies in.

2. The powder transporting device as claimed in claim 1, further comprising an entered powder exhausting opening that is formed in the loosening member, and exhausts the powder that is entered between the loosening member and the wall of the dropping path.

3. The powder transporting device as claimed in claim 1, further comprising movement limiting members that are arranged on both sides in a reciprocating direction of the loosening member so as to cross the loosening member and on a side where the rotary center is located with respect to a plane including lines drawn vertically from outer ends in a horizontal direction in a range where the contact between the reciprocation applying portion and the reciprocation applied portion moves, the movement limiting members limiting that the loosening member body moves in the reciprocating direction.

4. The powder transporting device as claimed in claim 1, wherein the loosening member includes:

a supported portion that is supported by the supporting portion and formed of a hole extending along the moving direction of the loosening member; and a scraping-off portion that is formed at a position overlapping the supported portion in the direction of gravity and scraping off the developer entered from the supported portion and applied between the loosening member and the wall of the dropping path.

5. The powder transporting device as claimed in claim 1, wherein the rotary center of the rotary member and the supporting portion are arranged at positions overlapping along the direction of gravity; and the supporting portion and the reciprocation applied portion are arranged at positions not crossing in the direction of gravity.

6. The powder transporting device as claimed in claim 1, wherein the reciprocation applying portion does not apply force to the loosening member toward the direction leaving the inner wall.

7. The powder transporting device as claimed in claim 1, wherein each of the pair of reciprocation applied portions has a plate shape.

8. The powder transporting device according to claim 1, wherein the loosening member includes a loosening member body that is formed as a plate shape and extends along the inner wall of the dropping path; and the pair of reciprocation applied portions protrude from the loosening member and are arranged to cross the rotary center and to be brought into contact with the reciprocation applying portion, each of the pair of reciprocation applied portions are formed as a plate shape, and the loosening member is provided along the inner wall of the dropping path, and reciprocated by contact between the reciprocation applying member and the pair of reciprocation applied portions while the rotary member rotates.

9. An image forming apparatus comprising:

a developer holder that holds developer;

a developer holder cleaner that removes the developer applied on a surface of the developer holder;

a dropping path through which the developer drops, the dropping path including an inner wall inclined in a direction of gravity;

a flow-in opening from which the developer removed by the developer holder cleaner flows into the dropping path;

a rotary member that includes:

a rotary center; and a reciprocation applying portion that is located at the position eccentric from the rotary center, the rotary member being arranged within the dropping path and rotationally driven;

a supporting portion that is provided on the inner wall of the developing path; and a loosening member that is supported by the supporting portion, wherein the loosening member includes: a loosening member body that is reciprocated along the inner wall in the direction crossing a dropping direction of a developer; and a pair of reciprocation applied portions that are provided in the loosening member body, and are brought into contact with the reciprocation applying portion, wherein the loosening member moves to left and right of the rotary center substantially orthogonal to a longitudinal axis of the dropping path along the inner wall of the dropping path by contact between the reciprocation applying portion and the pair of reciprocation applied portions while the rotary member rotates;

wherein the loosening member further includes a flat surface on which the developer drops, the loosening member moving to the left and the right of the rotary center in the same plane that the flat surface lies in, wherein the upper end of a region of the loosening member body arranged along the inner wall of the dropping path, in a case where the loosening member is reciprocated, is always located at a position in the direction of gravity higher than a position where a line drawn from the flow-in opening in the direction of gravity and the loosening member body cross.

10. The powder transporting device as claimed in claim 9, wherein the loosening member includes:

a supported portion that is supported by the supporting portion and formed of a hole extending along the moving direction of the loosening member; and a pair of reciprocation applied portions that are arranged to cross the rotary center to be brought into contact with the reciprocation applying portion, and are reciprocated by contact between the reciprocation applying portion and the reciprocation applied portion while the rotary member rotates; and the lower end of the hole in the direction of gravity, in a case where the loosening member is reciprocated, is always located at the upper position in the direction of gravity than the position where the line drawn from the flow-in opening in the direction of gravity and the loosening member body cross.

11. The image forming apparatus as claimed in claim 9, further comprising an entered developer exhaust opening that is formed in the loosening member, and exhausts the developer entered between the loosening member and the wall of the dropping path, wherein the upper end of the developer exhausting opening, in a case where the loosening member is reciprocated, is always located at a lower position in the direction of gravity than the position where a line drawn from the flow-in opening in the direction of gravity and the inner wall cross.

12. The image forming apparatus as claimed in claim 9, further comprising a transporting member that includes:

a rotary shaft; and a transporting blade that is supported by the rotary shaft, the transporting member rotating in a predetermined rotating direction to transport the developer removed by the developer removing member toward the flow-in opening, wherein the loosening member is movably supported in an obliquely downward direction having a downward component in the direction of gravity on a side where the transporting member rotates in an upward direction from below in the direction of gravity at a position opposite to the flow-in opening.

13. The image forming apparatus as claimed in claim 9, further comprising a transporting member that includes:

a rotary shaft; and a transporting blade that is supported by the rotary shaft, and rotates in a predetermined rotating direction to transport the developer removed by the developer removing member toward the flow-in opening, wherein the supporting portion is arranged on a side where the transporting member rotates in an upward direction from below in the direction of gravity at a position opposite to the flow-in opening.

14. The image forming apparatus according to claim 9, wherein the loosening member is formed as a plate shape and extends along the inner wall of the dropping path; and the pair of reciprocation applied portions protrude from the loosening member and are arranged to cross the rotary center and to be brought into contact with the reciprocation applying portion, each of the pair of reciprocation applied portions are formed as a plate shape, and the loosening member is provided along the inner wall of the dropping path, and reciprocated by contact between the reciprocation applying member and the pair of reciprocation applied portions while the rotary member rotates.

15. An image forming apparatus comprising:

a developer holder that holds developer;

a developer holder cleaner that removes the developer applied on the surface of the developer holder;

a body frame that includes a holding portion holding the developer holder and the developer holder cleaner;

a dropping forming frame that is provided in the body frame and incorporates a dropping path through which the developer drops, the dropping path having an inner wall inclined in the direction of gravity;

a flow-in opening from which the developer removed by the developer holder cleaner flows into the dropping path;

a rotary member that includes:

a rotary center; and a reciprocation applying portion that is located at a position eccentric from the rotary center, the rotary member being arranged within the dropping path and rotationally driven;

a loosening member that includes:

a loosening member body that is reciprocated along the inner wall in the direction crossing a dropping direction of the developer; and a pair of reciprocation applied portions that are provided in the loosening member body, and are brought into contact with the reciprocation applying portion, and a drive transmitting unit that is integrally configured by:

the rotary member; and a drive transmitting system that transmits a drive to the rotary member, the drive transmitting unit being detachable from the dropping path forming frame provided in the body frame:

wherein the loosening member moves to left and right of the rotary center substantially orthogonal to a longitudinal axis of the dropping path along the inner wall of the dropping path by contact between the reciprocation applying portion and the pair of reciprocation applied portions while the rotary member rotates, and the loosening member further includes a flat surface on which the developer drops, the loosening member moving to the left and the right of the rotary center in the same plane that the flat surface lies in.

16. The image forming apparatus as claimed in claim 15, further comprising a transporting member that includes:

a rotary shaft; and a transporting blade that is supported by the rotary shaft, the transporting member rotating in a predetermined rotating direction to transport the developer removed by the developer removing member toward the flow-in opening, wherein the loosening member is movably supported in an obliquely downward direction having a downward component in the direction of gravity on a side where the transporting member rotates in an upward direction from below in the direction of gravity at a position opposite to the flow-in opening.

17. The image forming apparatus as claimed in claim 15, further comprising a transporting member that includes:

a rotary shaft; and a transporting blade that is supported by the rotary shaft, and rotates in a predetermined rotating direction to transport the developer removed by the developer removing member toward the flow-in opening, wherein the supporting portion is arranged on a side where the transporting member rotates in an upward direction from below in the direction of gravity at a position opposite to the flow-in opening.

18. The image forming apparatus according to claim 15, wherein the loosening member is formed as a plate shape and extends along the inner wall of the dropping path; and the pair of reciprocation applied portions protrude from the loosening member and are arranged to cross the rotary center and to be brought into contact with the reciprocation applying portion, each of the pair of reciprocation applied portions are formed as a plate shape, and the loosening member is provided along the inner wall of the dropping path, and reciprocated by contact between the reciprocation applying member and the pair of reciprocation applied portions while the rotary member rotates.

* * * * *